US007907876B2

(12) United States Patent
Ohsawa et al.

(10) Patent No.: US 7,907,876 B2
(45) Date of Patent: Mar. 15, 2011

(54) DEVELOPER CARRIER, DEVELOPMENT DEVICE, PROCESS CARTRIDGE, AND IMAGE FORMING APPARATUS

(75) Inventors: Masayuki Ohsawa, Atsugi (JP); Tadaaki Hattori, Hadano (JP); Kyohta Koetsuka, Fujisawa (JP); Yoshiyuki Takano, Hachiohji (JP); Noriyuki Kamiya, Yamato (JP); Rei Suzuki, Atsugi (JP); Hiroya Abe, Yokohama (JP); Takashi Innami, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 9 days.

(21) Appl. No.: 12/555,532

(22) Filed: Sep. 8, 2009

(65) Prior Publication Data

US 2010/0067959 A1 Mar. 18, 2010

(30) Foreign Application Priority Data

Sep. 8, 2008 (JP) ..... 2008-229400

(51) Int. Cl.
*G03G 15/09* (2006.01)

(52) U.S. Cl. ..... 399/277

(58) Field of Classification Search ..... 399/111, 399/119, 252, 265, 267, 274–277
See application file for complete search history.

(56) References Cited

U.S. PATENT DOCUMENTS

| | | | | |
|---|---|---|---|---|
| 6,665,511 | B2 * | 12/2003 | Takeuchi et al. | 399/267 |
| 7,027,761 | B2 * | 4/2006 | Koetsuka et al. | 399/277 |
| 7,308,223 | B2 * | 12/2007 | Kurosu | 399/267 |
| 7,440,718 | B2 * | 10/2008 | Hagiwara et al. | 399/270 |
| 7,486,917 | B2 * | 2/2009 | Akita | 399/277 |
| 2004/0234299 | A1 | 11/2004 | Koetsuka et al. | |
| 2005/0135843 | A1 | 6/2005 | Kakegawa et al. | |
| 2008/0008503 | A1 | 1/2008 | Imamura et al. | |
| 2008/0170891 | A1 | 7/2008 | Abe et al. | |

FOREIGN PATENT DOCUMENTS

| | | |
|---|---|---|
| JP | 60-93471 | 5/1985 |
| JP | 2960298 | 7/1999 |
| JP | 2002-251071 | 9/2002 |
| JP | 2002-278281 | 9/2002 |
| JP | 2003-323050 | 11/2003 |
| JP | 2004-212560 | 7/2004 |
| JP | 2006-23784 | 1/2006 |
| JP | 2006-71732 | 3/2006 |
| JP | 2007-86091 | 4/2007 |
| JP | 2007-178991 | 7/2007 |

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A developer carrier includes a magnetic field generating device provided with a plurality of magnetic poles including an agent separating pole and a scooping pole, and a cylindrical hollow body accommodating therein the magnetic field generating device and rotated around an axis of the cylindrical hollow body. A half-value width of a magnetic flux density at both end portions of at least one magnetic pole of the agent separating pole and the scooping pole is formed to be identical to or narrower than a half-value width of the magnetic flux density at a central portion of the one magnetic pole.

9 Claims, 8 Drawing Sheets

DEVELOPER CARRIER, DEVELOPMENT DEVICE, PROCESS CARTRIDGE, AND IMAGE FORMING APPARATUS

CROSS-REFERENCE TO THE RELATED APPLICATION

This application is based on and claims the priority benefit of Japanese Patent Application No. 2008-229400, filed on Sep. 8, 2008, the disclosure of which is incorporated herein by reference in its entirety.

FIELD OF THE INVENTION

The present invention relates to: a developer carrier (developing roller) for visualizing an electrostatic latent image; a development device including the developer carrier; a process cartridge including the development device; and an image forming apparatus—such as a copier, a printer, a facsimile, and a plotter—including the development device or the process cartridge.

DESCRIPTION OF THE RELATED ART

Generally, in an electrophotographic image forming apparatus, an electrostatic latent image corresponding to image information is formed on a latent image carrier including a photoreceptor drum, a photoreceptor belt and the like, then, developing operation is performed by a development device, and thus, a visible image is obtained. In such electrophotographic development processing, a magnetic brush development method is widely used. When a two-component developer composed of toner and magnetic particles is used in this magnetic brush development, development is performed by: forming a magnetic brush by causing the developer to magnetically adsorbed on an outer circumferential face of a developer carrier; and then selectively supplying toner from the above-mentioned magnetic brush and causing the toner to adhere to a latent image surface facing the latent image carrier, in a developing region (a region between the developer carrier and a latent image carrier where an electric field capable of development is secured), by using an electric field between the latent image carrier on which an electrostatic latent image is formed and a sleeve to which an electric bias is applied.

The developer carrier used in the above-described image forming apparatus is provided with: a magnetic field generating device (magnet roller) including multiple magnetic poles having an agent separating pole and a scooping pole; and a cylindrical hollow body (developing sleeve) rotated around its axis and accommodating therein the magnetic field generating device. The above-mentioned developer is scooped (adsorbed) from a developer supplying unit to an outer circumferential face of the hollow body by a magnetic force generated by the magnetic field generating device of the developer carrier, is then carried and conveyed to the above-mentioned developing region for use in development, and thereafter separated (agent separated) from the outer circumferential face of the hollow body to the developer supplying unit. The developer thus separated to the developer supplying unit is conveyed to a developer discharging container for disposal, or is agitated to such an extent that toner and magnetic particles may become uniform, and then reused for development.

In recent years, there has been a significantly increasing demand that the above-mentioned image forming apparatus provides high image quality. In response to such a demand, Japanese Patent Application Publication Nos. 2003-323050 and 2004-212560, and the like achieve high image quality by use of techniques using only a direct current as a developing bias, for example.

However, at both longitudinal-direction end portions of the above-mentioned developer carrier, a phenomenon of "entrainment of a developer" occasionally occurs in which the developer once used for development is continuously carried and conveyed to a developing region and is used for development, without being separated from the outer circumferential face of the hollow body to a developer supplying unit. If such entrainment of a developer occurs, a magnetic brush is formed by a developer with an insufficient toner amount, and the toner cannot be sufficiently supplied and adhered to a latent image carrier. This causes a problem that the phenomenon of "void at end portion" occasionally occurs in which the concentration at both end portions of the formed image is reduced.

It is found, from the investigation by the inventors of the present invention, that such entrainment of a developer occurs due to the following reasons.

A plastic magnet or a rubber magnet formed in a cylindrical shape by mixing a magnetic powder, such as Sr ferrite or Ba ferrite, with a high molecular compound, is used for magnetic field generating device that constitutes a developer carrier. In such magnetic field generating device, a magnetic pole is formed on the outer circumferential face thereof by using a magnetizing jig 500 as shown in FIG. 3. The magnetizing jig 500 is a magnetized device including a pedestal 510 and a magnetizing yoke 620 with a rectangular shaped top face 521 in a plan view. The magnetizing jig 500 magnetizes the magnetic field generating device over the whole length in the axial direction of the magnetic field generating device, and forms magnetic poles, by bringing the top face 521 of the magnetizing jig 500 close to or into contact with the outer circumferential face of the magnetic field generating device.

It is found that when the magnetic poles are formed on the magnetic field generating device in this manner, a magnetic field having a width (a length in the circumferential direction of the magnetic field generating device) corresponding to the width of the magnetizing jig towards the normal line direction of the outer circumferential face of the magnetic field generating device is generated at a longitudinal-direction central portion of the magnetic field generating device. Meanwhile, at both longitudinal-direction end portions of the magnetic field generating device, the width of the magnetic field which adsorbs a developer is expanded in the circumferential direction of the magnetic field generating device because the magnetic field in the normal line direction of the outer circumferential face of the magnetic field generating device and the magnetic field in the axial direction from the end face of the magnetic field generating device are connected, so that the magnetic flux density of this magnetic field becomes larger. Furthermore, when the magnetic field at both the end portions of the magnetic field generating device is expanded in the circumferential direction, a range at the outer circumferential face of the hollow body (that is, a developer carrier) in which the developer is adsorbed is expanded in the circumferential direction and thereby approaches the adjacent magnetic pole. Therefore, the developer has difficulty in separating from the outer circumferential face of the hollow body, so that entrainment of the developer occurs.

An object of the present invention is to provide a developer carrier, a development device, a process cartridge, and an image forming apparatus which can prevent entrainment of a developer by the developer carrier and can provide an image with uniform concentration.

The inventors of the present invention repeatedly performed experiments and keen examinations by paying attention to half-value widths of magnetic flux densities in an agent separating pole and a scooping pole, among multiple parameters showing magnetic properties. An agent separating pole here is a magnetic pole that mainly separates a developer from a developer carrier by a magnetic force, and a scooping pole here is a magnetic pole that adsorbs and holds a two-component developer composed of toner and magnetic carrier from a developer supplying unit, at the developer carrier by a force of the magnetic pole. As a result, a correlation between the half-value width of the magnetic flux density and the entrainment of a developer shown below is found out.

FIG. 6 is a schematic diagram explaining a half-value width and a half-value central angle of a magnetic flux density. FIG. 6 shows that the further a solid line B separates from an outer circumferential face 26*a* of a hollow body 26, the larger a magnetic flux density in the normal line direction becomes. A half-value width W of a magnetic flux density (hereafter, referred to as a "half-value width") indicates, as an outline thereof is shown in FIG. 6, the size of a portion in the circumferential direction where a value of the magnetic flux density which is larger than half of the maximum value of the magnetic flux density in the normal line direction of the magnetic field is generated in the magnetic field generated in the outer circumferential face of the hollow body (that is, developer carrier) 26 by the magnetic pole of magnetic field generating device 25. The half-value width W is indicated by an angle [°] in the circumferential direction in an axis P of the developer carrier. Furthermore, the position of the half-value width W of the magnetic flux density in the outer circumferential face of the developer carrier is indicated by a half-value central angle K. This half-value central angle K is an angle [°] in the circumferential direction at the axis P of the developer carrier, formed by a center position Q of the half-value width W in the circumferential direction and a reference position.

It is found that the circumferential-direction width of the outer circumferential face of the developer carrier where a developer is adsorbed changes according to the half-value width W of the magnetic flux density. More specifically, it is found that the larger (wider) the half-value width is, the wider the range in which the developer is adsorbed expands in the circumferential direction, and the smaller (narrower) the half-value width is, the narrower the range in which a developer is adsorbed narrows in the circumferential direction. Furthermore, it is found that if the half-value width of the magnetic flux density at both longitudinal-direction end portions of a magnetic pole is wider than the half-value width of the magnetic flux density at a longitudinal-direction central portion of the magnetic pole, a range in which a developer is adsorbed relatively expands in the circumferential direction, at both the end portions of the outer circumferential face of the developer carrier. By contrast, if the half-value width of the magnetic flux density at both the longitudinal-direction end portions of the magnetic pole is identical to or narrower than the half-value width of the magnetic flux density at the longitudinal-direction central portion of the magnetic pole, a range in which a developer is adsorbed can be prevented from relatively expanding in the circumferential direction at both the end portions of the outer circumferential face of the developer carrier.

Therefore, to attain the above-mentioned object, a developer carrier according to one embodiment of the present invention is provided with: magnetic field generating device including multiple magnetic poles having an agent separating pole and a scooping pole; and a cylindrical hollow body to be rotated around its axis with the magnetic field generating device accommodated therein. In the developer carrier, a half-value width of a magnetic flux density at both end portions of at least one magnetic pole of the agent separating pole and the scooping pole is formed to be either identical to a half-value width of the magnetic flux density at a central portion of the magnetic pole or narrower than the half-value width of the magnetic flux density at the central portion of the magnetic pole.

SUMMARY OF THE INVENTION

According to the present invention, as mentioned above, in a developer carrier which is provided with: a magnetic field generating device including a plurality of magnetic poles having an agent separating pole and a scooping pole; and a cylindrical hollow body accommodating therein the magnetic field generating device and rotated around an axis of the cylindrical hollow body, wherein a half-value width of a magnetic flux density at both end portions of at least one magnetic pole of the agent separating pole and the scooping pole is formed to be identical to a half-value width of the magnetic flux density at a central portion of the one magnetic pole, or narrower than the half-value width of the magnetic flux density at the central portion of the one magnetic pole. Accordingly, the disengagement property (agent separation property) of a developer at both the end portions of the agent separating pole of the developer carrier can be improved, or the developer can be prevented from re-adsorbing continuously at both the end portions of the scooping pole of the developing roller 16. Therefore, it is possible to provide the developer carrier that can prevent the entrainment of a developer and thus can obtain an image with uniform concentration.

The half-value width of the magnetic flux density at both the end portions of the agent separating pole is formed to be identical to the half-value width of the magnetic flux density at the central portion of the agent separating pole, or narrower than the half-value width of the magnetic flux density at the central portion of the agent separating pole, and a center position of the half-value width of the magnetic flux density at both the end portions of the agent separating pole is arranged on the upstream side in a rotational direction of the hollow body from a center position of the half-value width of the magnetic flux density at the central portion of the agent separating pole. Accordingly, a range where the developer in the magnetic field at both the end portions of the agent separating pole of the developer carrier is adsorbed can be arranged so as to further separate from the upstream side in the rotational direction of the hollow body, that is, the scooping pole. Therefore, it is possible to provide the developer carrier with the further improved disengagement property of the developer at both the end portions of the agent separating pole of the developer carrier.

The half-value width of the magnetic flux density at both the end portions of the scooping pole is formed to be identical to the half-value width of the magnetic flux density at the central portion of the scooping pole, or narrower than the half-value width of the magnetic flux density at the central portion of the scooping pole, and a center position of the half-value width of the magnetic flux density at both the end portions of the scooping pole is arranged on the downstream side in a rotational direction of the hollow body from a center position of the half-value width of the magnetic flux density at the central portion of the scooping pole. Accordingly, a range where the developer in the magnetic field at both the end portions of the scooping pole of the developer carrier is adsorbed can be arranged so as to further separate from the downstream side in the rotational direction of the hollow body, that is, the agent separating pole. Therefore, it is possible to provide the developer carrier that can prevent the developer from being re-adsorbed continuously at both the end portions of the scooping pole of the developer carrier.

Surface roughening processing is performed on outer circumferential face of the hollow body in such a way that a plurality of line materials are caused, by the rotating magnetic field, to rotate along the outer circumferential face of the hollow body while each rotating on an axis of the line material, and to thereby collide with the outer circumferential face. Therefore, it is possible to provide the developer carrier that can obtain an image with uniform concentration and with less temporal degradation.

In a development device having at least a developer carrier, the development device has the developer carrier according to any one of claims 1 to 4 as the developer carrier. Therefore, it is possible to provide the development device that can prevent the entrainment of a developer and thus can obtain an image with uniform concentration.

A developer carried by the developer carrier includes toner and a magnetic carrier, and an average particle diameter of the magnetic carrier is set at 20 μm to 50 μm. Therefore, it is possible to provide the development device that can develop an image temporally stabilized and excellent in granularity.

In a process cartridge having at least a development device, the process cartridge has the development device according to claim 5 or 6 as the development device. Therefore, it is possible to provide the process cartridge that can prevent the entrainment of a developer and thus can obtain an image with uniform concentration.

In an image forming apparatus having at least a development device, the image forming apparatus has the development device according to claim 5 or 6 as the development device. Therefore, it is possible to provide the image forming apparatus that can prevent the entrainment of a developer and thus can obtain an image with uniform concentration.

In an image forming apparatus provided at least with a process cartridge having at least a development device, the image forming apparatus is provided with the process cartridge according to the present invention as the process cartridge. Therefore, it is possible to provide the image forming apparatus that can prevent the entrainment of a developer and thus can obtain an image with uniform concentration.

BRIEF DESCRIPTION OF THE DRAWINGS

FIG. 5A shows a magnetic flux density distribution of the magnetic pole formed by the magnetizing yoke having a width of both the end portions of the top face identical to a width of a central portion; FIG. 5B shows the magnetic flux density distribution of the magnetic pole formed by the magnetizing yoke in which the width of both the end portions of the top face is formed narrower than the width of the central portion, and a center position of the width of both the end portions and a center position of the width of the central portion is provided on the same line; and FIG. 5C shows the magnetic flux density distribution of the magnetic pole formed by the magnetizing yoke in which the width of both the end portions of the top face is formed narrower than the width of the central portion, and the center position of the width of both the end portions is provided offset from the center position of the width of the central portion.

DETAILED DESCRIPTION OF THE PREFERRED EMBODIMENTS

Embodiments of a developer carrier, a development device, a process cartridge, and an image forming apparatus according to the present invention are described below in detail with reference to accompanying drawings.

Firstly, a developing roller which is one embodiment of the developer carrier according to the present invention is described with reference to FIGS. 1 to 7.

A developing roller 16 is a member for carrying a developer on the outer circumferential face thereof and carrying and transporting the developer to a developing region formed between the developing roller 16 and a photoreceptor body 1, which is described later.

Figure 1:
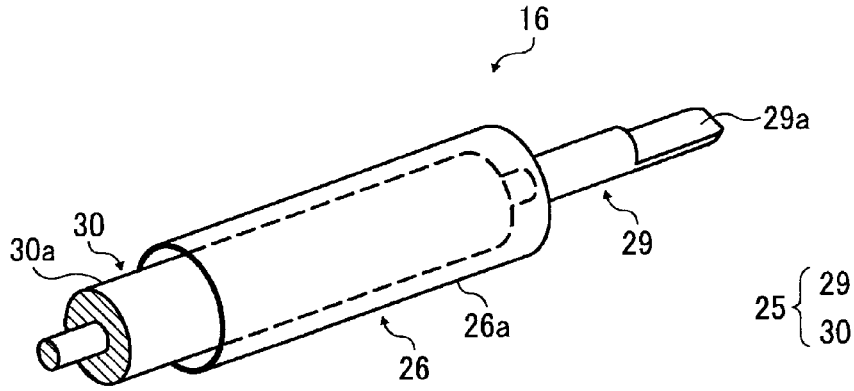
FIG. 1 is an exploded perspective view of a part of a developing roller according to the present invention.

The developing roller 16 is provided with a magnet roller 25 as a magnetic field generating device and a developing sleeve 26 as a hollow body as shown in FIG. 1.

The magnet roller 25 includes a cored bar 29 made of a hard metal or the like, and a cylindrical body part 30 composed of a plastic magnet, a rubber magnet, or the like as obtained by mixing a magnetic powder with a high molecular compound and using the cored bar 29 as a center of the axis. The cored bar 29 is unrotatably fixed to a case of a development device 4, which is described later, or the like. Furthermore, the cored bar 29 and body part 30 are also fixed to each other. As a magnetic powder, Sr ferrite or Ba ferrite, for example, can be used for body part 30, and as a high molecular compound, a polyamide-based material, such as 6PA or 12PA, an ethylene-based compound, such as an ethylene ethyl copolymer or an ethylene vinyl copolymer, a chlorine-based material, such as chlorinated polyethylene, and a rubber material, such as NBR, for example, can be used. The magnet roller 25 is provided with multiple magnetic poles that are formed in the N poles or the S poles over the whole length along the axial direction.

Figure 2:
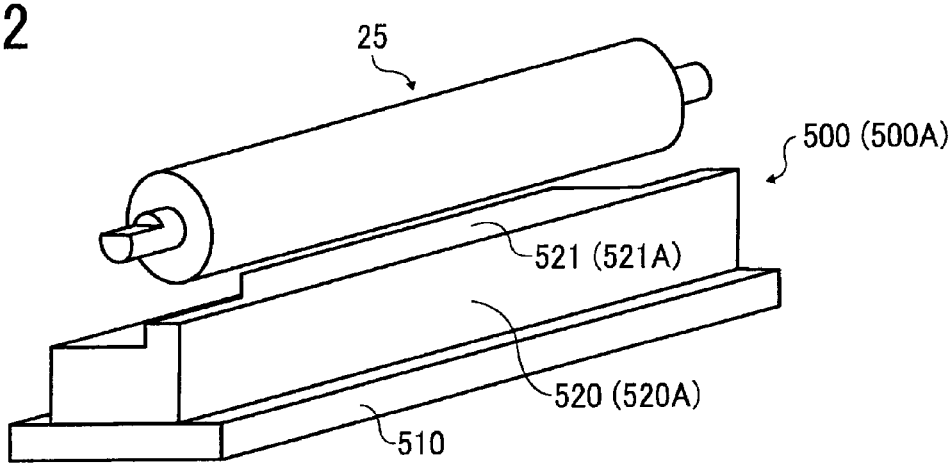
FIG. 2 is a perspective view showing an example of an outline of a magnetizing jig magnetized to a magnet roller included in the developing roller in FIG. 1.
Figure 3:
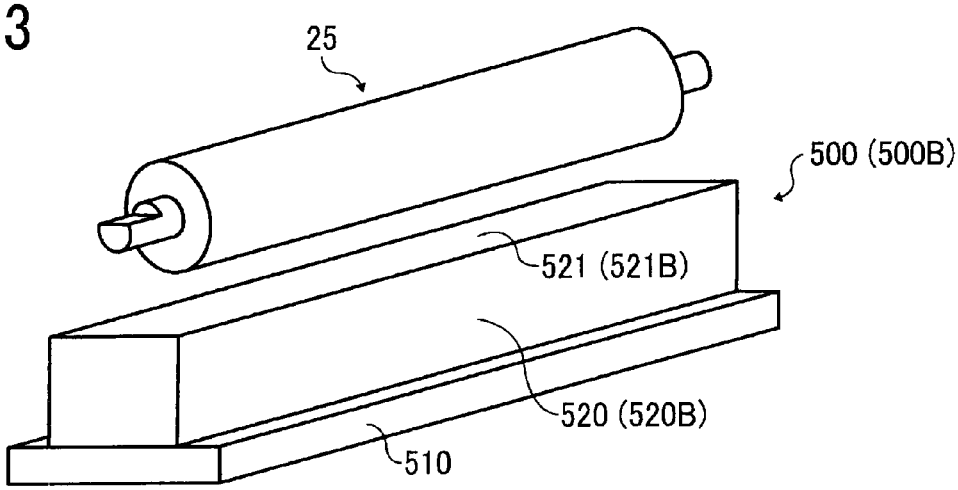
FIG. 3 is a perspective view showing another example of an outline of a magnetizing jig magnetized to the magnet roller included in the developing roller in FIG. 1.

These multiple magnetic poles are directly formed on an outer circumferential face 30*a* of the body part 30 of the magnet roller 25 by using a magnetizing jig 500 shown in FIGS. 2 and 3. The magnetizing jig 500 is provided with a pedestal 510 and a magnetizing yoke 520 that is provided on the pedestal 510 and generates a strong magnetic field. The magnetizing yoke 520 includes a magnetizing coil or the like as, which is not shown, arranged thereon so that the uniform magnetic field of the N pole or the S pole may be produced all over a top face 521 thereof. The magnetizing yoke 520 is made to be close to or to be abutted on the outer circumferential face 30*a* so that each magnetic pole is formed in the magnet roller 25.

Figure 4:
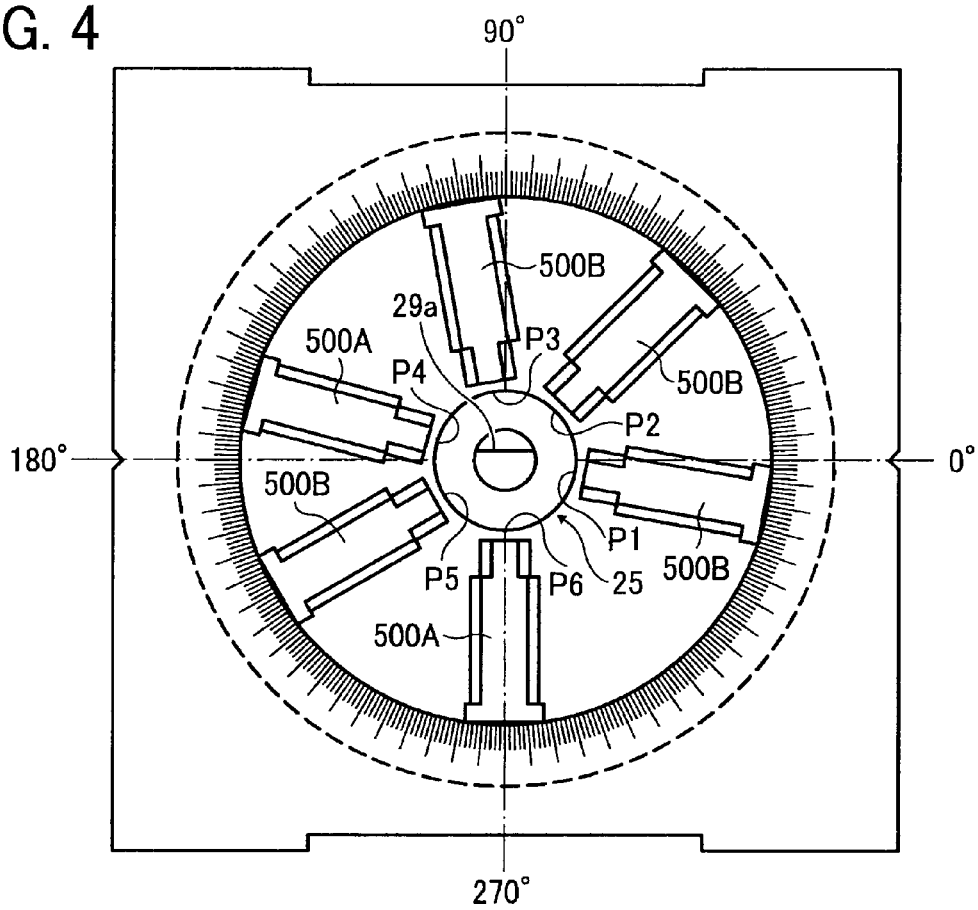
FIG. 4 is a side view showing a positional relation between the magnet roller and the magnetizing jig when multiple magnetic poles are formed on the magnet roller.

The magnetic property of the magnetic pole formed, on the outer circumferential face 30*a* of the body part 30 of the magnet roller 25, by the magnetizing jig 500 changes with a plan view shape of top face 521 of the magnetizing yoke 520. For example, as shown in FIG. 2, assume that a plan view shape of the top face 521 (indicated by a reference numeral 521A) of the magnetizing yoke 520 has a certain width of both end portions in the longitudinal direction narrower than a width of a central portion in the longitudinal direction. In this case, by adjusting each width suitably, a half-value width W of the magnetic flux density at both end portions (hereafter, also referred to the "both end portions") of the magnetic pole in the longitudinal direction can be made identical to or smaller (narrower) than a half-value width V of the magnetic flux density at central portion (hereafter, also referred to the "central portion") of the magnetic pole in the longitudinal direction. Furthermore, the maximum value of the magnetic flux density at both the end portions (hereafter, also referred to the "peak magnetic flux density") can be also made identical to or smaller than that at the central portion. By using the magnetizing jig 500 (indicated by a reference numeral 500A) provided with the magnetizing yoke 520 (indicated by a reference numeral 520A), an agent separating pole P4 and a scooping pole P6, which are shown in FIG. 4, are formed. Moreover, in the above configuration, the half-value width or the peak magnetic flux density at both the end portions may be adjusted by lowering the flat-surface height at both the end portions of the top face 521 than the flat-surface height at the central portion, and making the width of both the end portions of the top face 621 narrower than the width of the central portion.

The agent separating pole P4 and the scooping pole P6 are preferably formed by using the magnetizing jigs 500A in which the plan view shape of the top face 521 is convex and convex parts of the magnetizing yokes 520A face each other. With this manner, a center position Q of the half-value width W of the magnetic flux density at both the end portions of the agent separating pole P4 is arranged on the upstream side of the rotational direction of the developing sleeve 26 from a center position R of the half-value width V of the magnetic flux density at the central portion of the agent separating pole P4; at the same time, the half-value width W of the magnetic flux density at both the end portions of the agent separating pole P4 is formed to be identical to or narrower than the half-value width V of the magnetic flux density at the central portion of the agent separating pole P4. Furthermore, a center position Q of the half-value width W of the magnetic flux density at both the end portions of the scooping pole P6 is arranged on the downstream side in the rotational direction of the developing sleeve 26 from a center position R of the half-value width V of the magnetic flux density at the central portion of the scooping pole P6; at the same time, the half-value width W of the magnetic flux density at both the end portions of the scooping pole P6 is formed to be identical to or narrower than the half-value width V of the magnetic flux density at the central portion of the scooping pole P6. Either one of the agent separating pole P4 and the scooping pole P6 may be formed by using the magnetizing jig 500A.

As shown in FIG. 3, when the plan view shape of the top face 521 (indicated by a reference numeral 521B) of the magnetizing yoke 520 is a rectangle, the half-value width of the magnetic flux density at the central portion of the magnetic pole is larger than the half-value width of the magnetic flux density at both the end portions of the magnetic pole, and the peak magnetic flux density at both the end portions is also larger than that of the central portion. By using the magnetizing jig 500 (indicated by a reference numeral 500B) provided with such the magnetizing yoke 520 (indicated by a reference numeral 520B), a developing main pole P1, conveyance poles P2, P3, and an auxiliary pole P5, shown in FIG. 4, are formed.

Figure 5A:
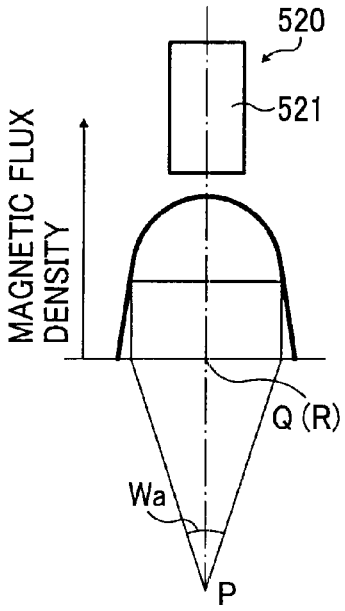
FIGS. 5A to 5C are schematic views showing relations between a plan view shape of the top face end portion of a magnetizing yoke and a shape of a magnetic flux density distribution of a magnetic pole to be formed.
Figure 5B:
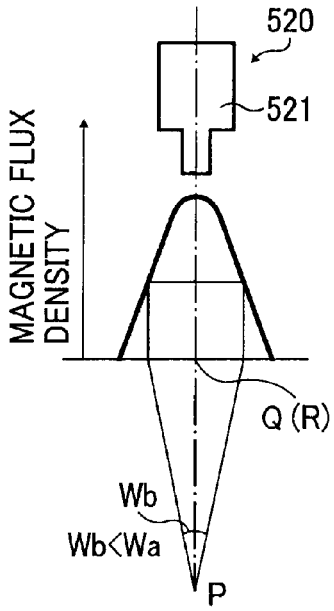
Figure 5C:
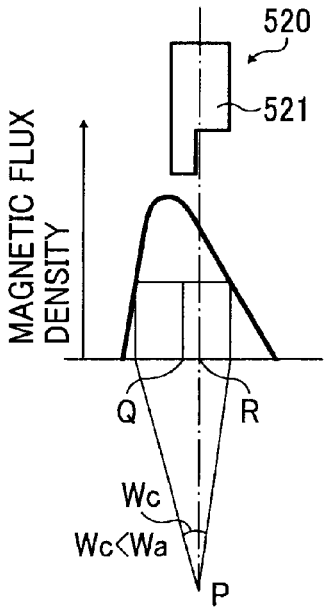
Figure 6:
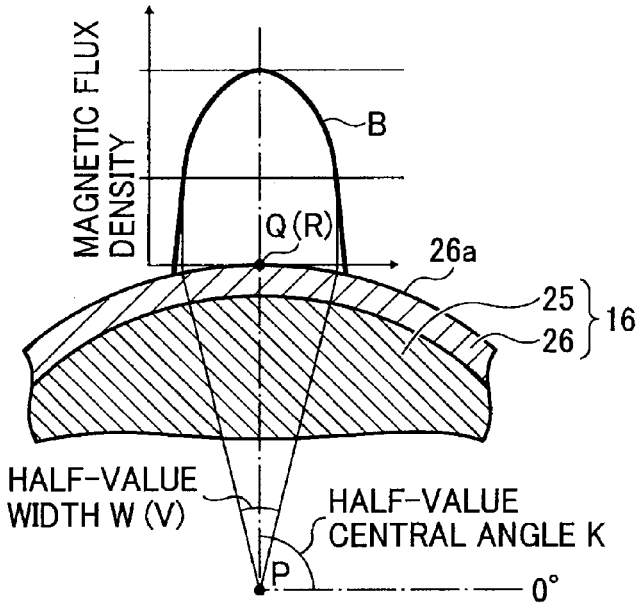
FIG. 6 is a view explaining a half-value width and a half-value central angle of a magnetic flux density.

FIGS. 5A, 5B, and 5C show imaged views of the plan view shape of an end portion of the top face 521 of the magnetizing yoke 520, and the magnetic flux density distribution shapes at both the end portions of the magnetic pole formed by the magnetizing yoke 520. FIG. 5A shows the magnetic flux density distribution of the magnetic pole formed by the magnetizing yoke 520 having the width at both the end portions of the top face 521 identical to the width at the central portion thereof. FIG. 5B shows the magnetic flux density distribution of the magnetic pole formed by the magnetizing yoke 520 in which the width at both the end portions of the top face 521 is formed narrower than the width at the central portion thereof, and the center position of the width at both the end portions is provided on the same line as the center position of the width at the central portion. FIG. 5C shows the magnetic flux density distribution of the magnetic pole formed by the magnetizing yoke 520 in which the width of both the end portions of the top face 521 is formed narrower than the width of the central portion thereof, and the center position of the width at both the end portions is provided offset from the center position of the width at the central portion. Each of FIGS. 5A to 5C shows an end portion of the top face 521 of the magnetizing yoke 520.

As shown in FIGS. 5B and 5C, the half-value width W of the magnetic flux density at both the end portions of the magnetic pole can be narrowed by making the width at both the end portions of the magnetizing yoke 520 narrower than the width at the central portion (Wb<Wa, Wc<Wa). Moreover, the center position Q of the half-value width W of the magnetic flux density at both the end portions of the magnetic pole can be offset from the center position R of the half-value width V of the magnetic flux density at the central portion of the magnetic pole, by offsetting the center position of the width at both the end portions of the magnetizing yoke 520 from the center position of the width at the central portion thereof.

The developing sleeve 26 is made of a non-magnetic substance, includes (accommodates) the magnet roller 25, and is rotatably provided around the center of the axis. The developing sleeve 26 is rotated so that an inner circumferential face thereof may sequentially face each of the magnetic poles of the magnet roller 25. The developing sleeve 26 is made of aluminum, stainless steel (SUS), or the like. Aluminum is excellent in processability and lightness. When aluminum is used, it is preferred to use A6063, A5056, and A3003. When SUS is used, it is preferred to use SUS303, SUS304, and SUS316.

In order to carry a developer, surface roughening processing is performed on an outer circumferential face 26*a* of the developing sleeve 26. The surface roughening processing includes V-shaped groove processing that forms V-shaped grooves regularly, sandblasting that sprays an abrasive powder, such as sand, or blasting processing, which is called SWB, that randomly forms concaves of an elliptical shape in a plan view by making multiple line materials that are rotated while rotating along the outer circumferential face of the hollow body to collide with each other by the rotating magnetic field. SWB is preferable as surface roughening processing. As for the concaves formed on the outer circumferential face 26*a*, the number of the concaves each of whose longitudinal direction of the elliptical shape in a plan view is in the axial direction of the developing sleeve 26, is preferably larger than the number of the concaves each of whose the longitudinal direction of the elliptical shape in a plan view is in the circumferential direction of the developing sleeve 26; moreover, the length (major axis) in the longitudinal direction of the concave is preferably formed of 0.05 mm to 0.3 mm, and the length (minor axis) in the short-side direction of the concave is formed of 0.02 mm to 0.1 mm. Refer to Japanese Patent Application Publication No. 2007-86091, filed by the inventors of the present invention for a device (surface treatment device) that performs SWB.

Figure 7:
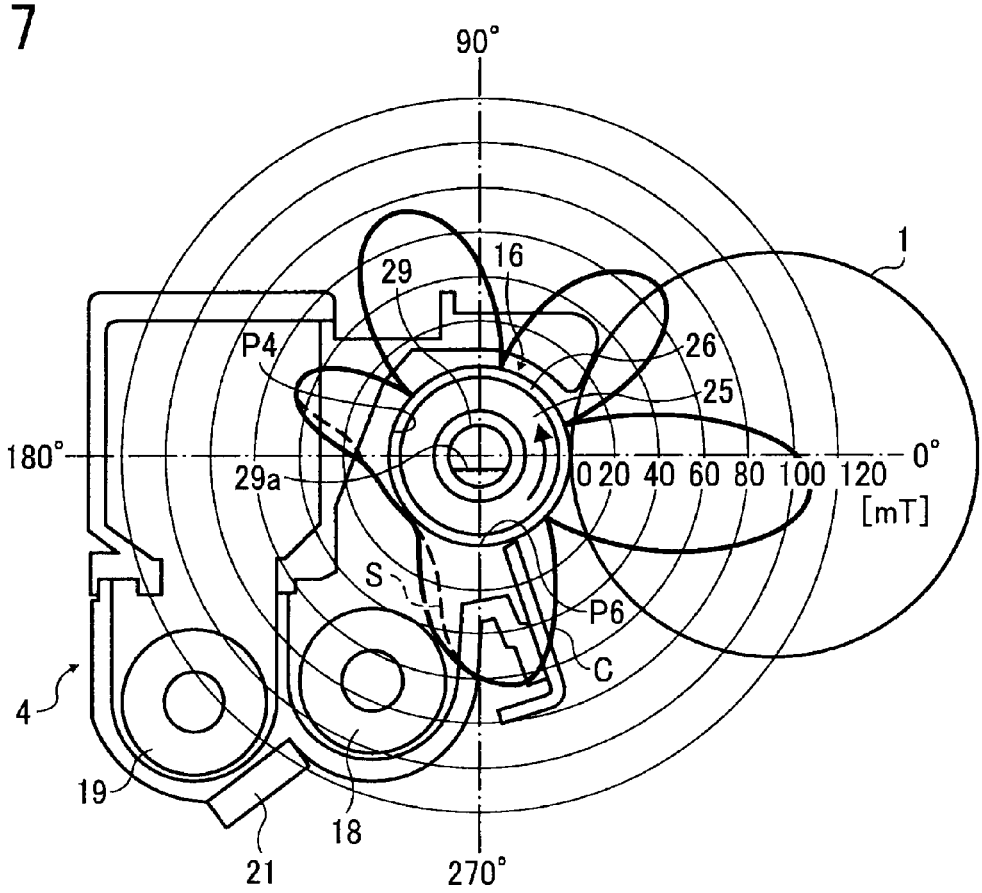
FIG. 7 is a side view showing an outline of the magnetic flux density distribution produced at an outer circumferential face of the developing roller of FIG. 1.

FIG. 7 schematically shows the magnetic flux density distribution formed by the developing roller 16 according to the present invention. A solid line C in FIG. 7 shows a magnetic flux density distribution of the longitudinal-direction central portion of the developing roller 16. A dotted line S in FIG. 7 shows the magnetic flux density distribution of both the longitudinal-direction end portions of the developing roller 16. The agent separating pole P4 is located dose to the upstream side in the rotational direction of the developing sleeve 26, while the magnetic flux density distribution of both the end portions thereof is narrow. The scooping pole P6 is located close to the downstream side in the rotational direction of the developing sleeve 26, while the magnetic flux density distribution of both the end portions thereof is narrow.

As mentioned above, according to the present invention, in the developing roller 16, the half-value width of the magnetic flux density at both the end portions of the magnetic pole of at least either one of the agent separating pole P4 and the scooping pole P6 is formed identical to the half-value width of the magnetic flux density in the central portion of the magnetic pole, or is formed narrower than the half-value width of the magnetic flux density in the central portion of the magnetic pole. Accordingly, the disengagement property (agent separation property) of a developer at both the end portions of the agent separating pole P4 of the developing roller 16 can be improved, or the developer can be prevented from re-adsorbing continuously at both the end portions of the scooping pole P6 of the developing roller 16. Therefore, it is possible to provide the developing roller 16 that can prevent the entrainment of a developer and thus can obtain an image with uniform concentration.

Furthermore, the center position of the half-value width of the magnetic flux density at both the end portions of the agent separating pole P4 is arranged on the upstream side, in the rotational direction of the developing sleeve 26, from the center position of the half-value width of the magnetic flux density at the central portion of the agent separating pole P4. Accordingly, a range where the developer in the magnetic field of both the end portions of the agent separating pole P4 of the developing roller 16 is adsorbed can be arranged so as to further separate from the upstream side in the rotational direction of the developing sleeve 26, that is, the scooping pole P6. Thus, it is possible to provide the developing roller 16 with the further improved disengagement property of the developer at both the end portions of the agent separating pole P4 of the developing roller 16.

Furthermore, the center position of the half-value width of the magnetic flux density at both the end portions of the scooping pole P6 is arranged on the downstream side, in the rotational direction of the developing sleeve 26, from the center position of the half-value width of the magnetic flux density at the central portion of the scooping pole P6. Accordingly, a range where the developer in the magnetic field of both the end portions of the scooping pole P6 of the developing roller 16 is adsorbed can be arranged so as to further separate from the downstream side of the rotational direction of the developing sleeve 26, that is, the agent separating pole P4. Thus, it is possible to provide the developing roller 16 that can prevent the developer from being re-adsorbed continuously at both the end portions of the scooping pole P6 of the developing roller 16.

Next, one embodiment of the development device according to the present invention is described with reference to FIGS. 8 to 12.

Figure 8:
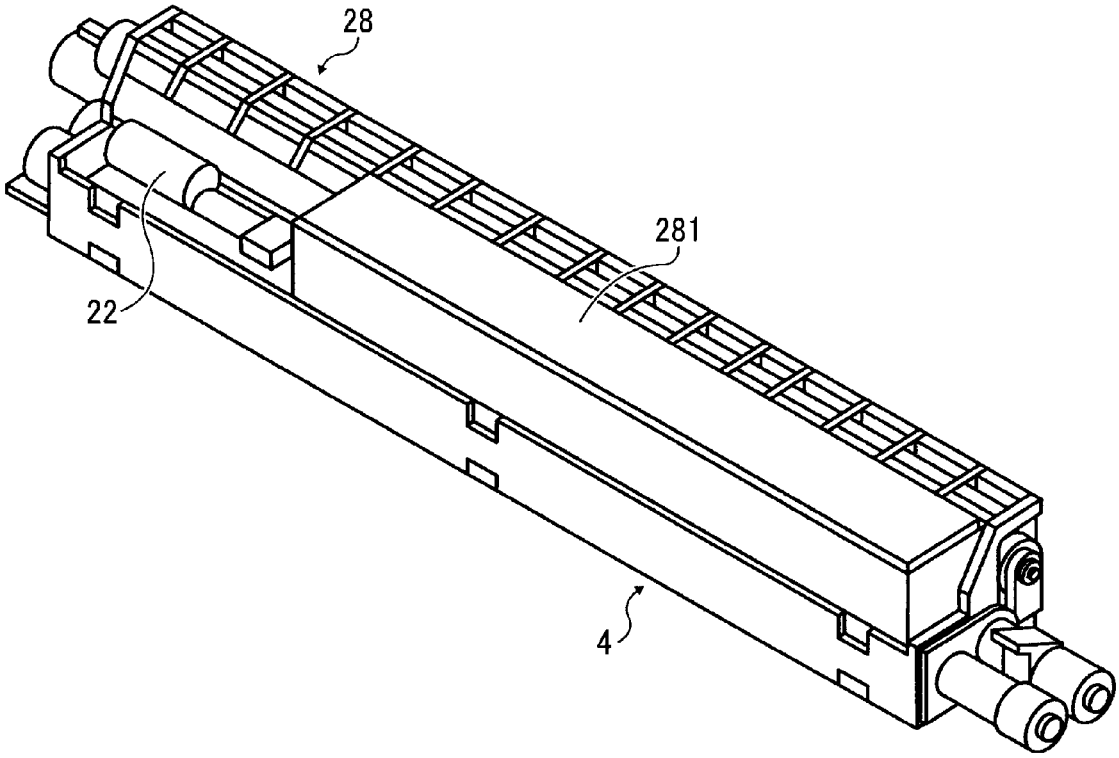
FIG. 8 is a perspective view of a development device according to the present invention.
Figure 9:
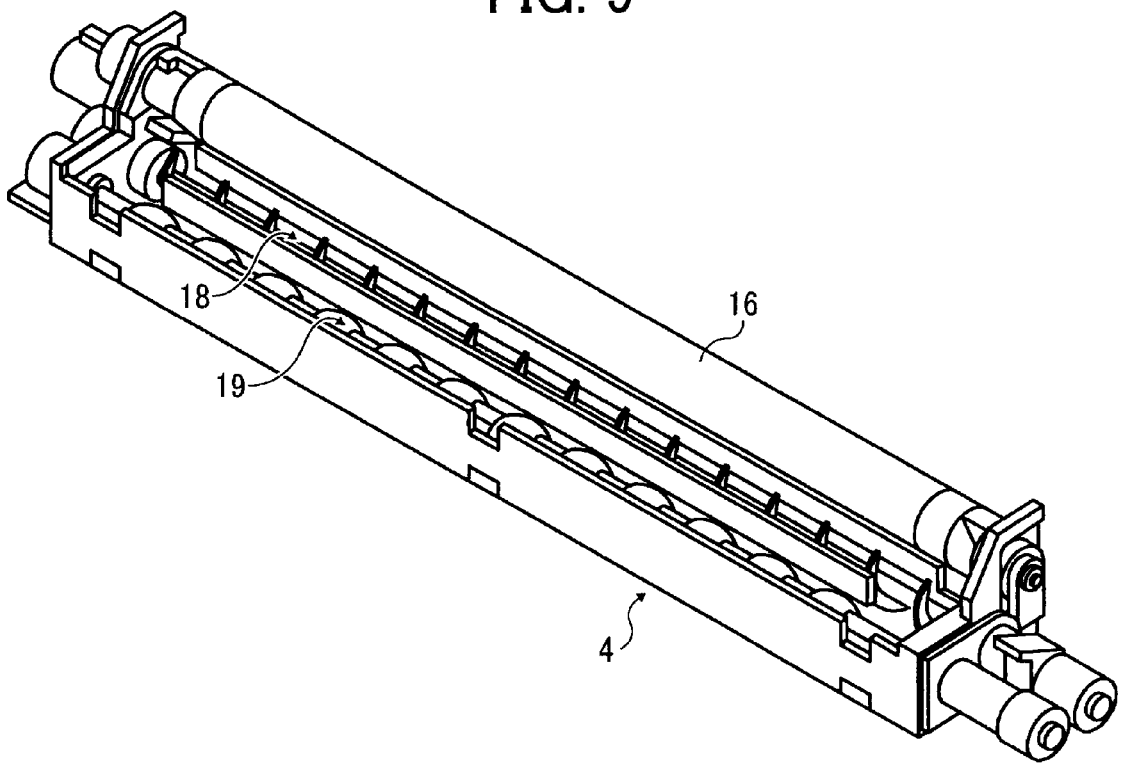
FIG. 9 is a perspective view showing a state where an upper case of the development device of FIG. 8 is removed.
Figure 10:
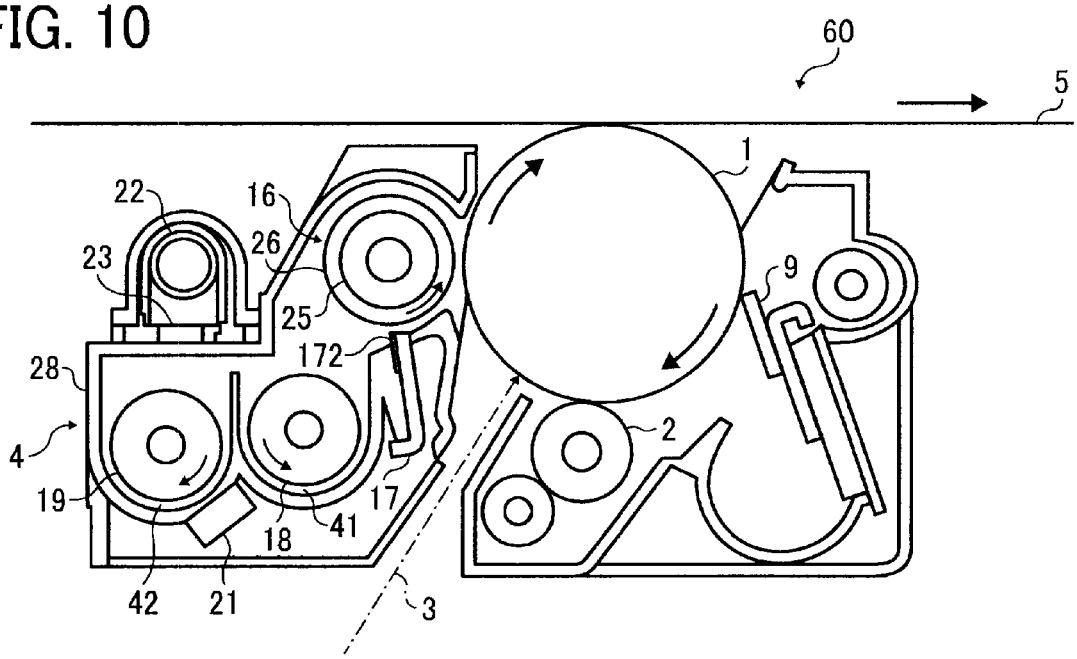
FIG. 10 is a sectional view of a process cartridge according to the present invention.
Figure 11:
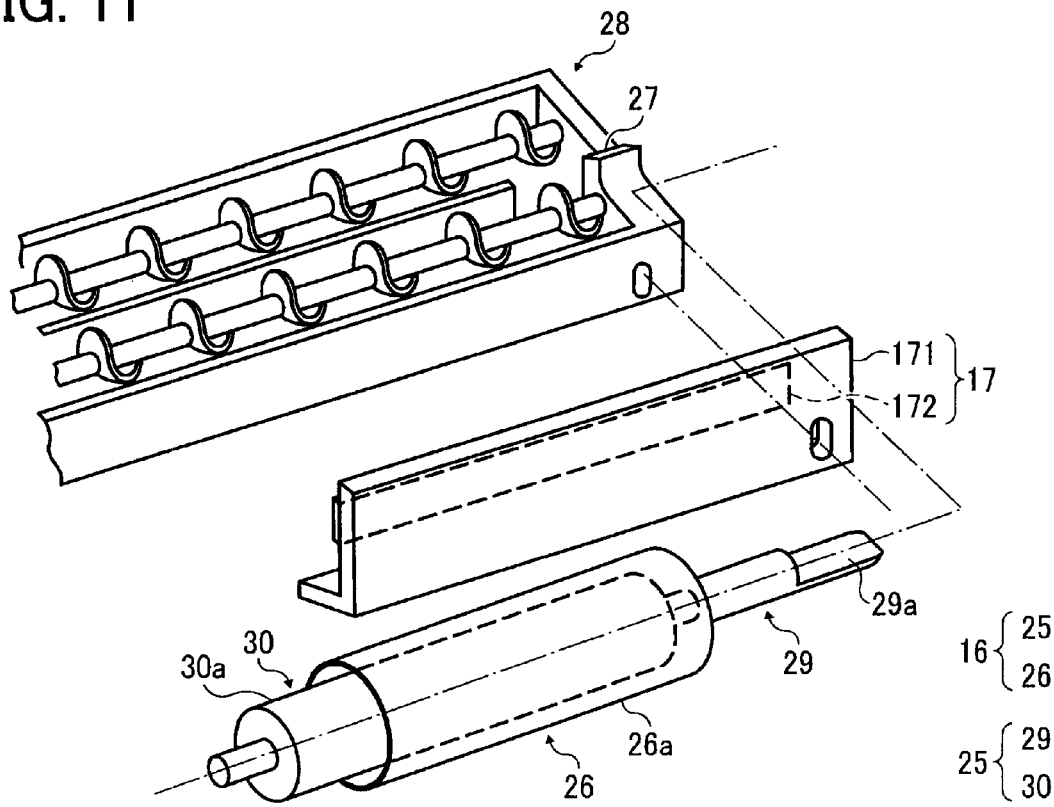
FIG. 11 is an exploded perspective view of a part of the development device of FIG. 8.
Figure 12:
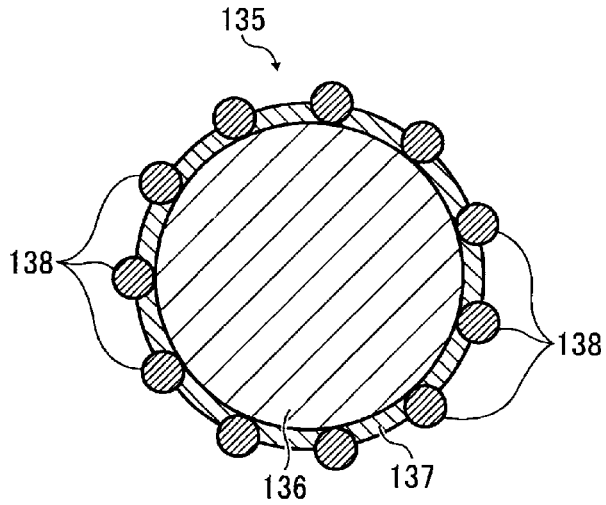
FIG. 12 is a sectional view of a magnetic carrier contained in a developer used in the development device of FIG. 8.

FIG. 8 is a perspective view of the development device according to the present invention. FIG. 9 is a perspective view showing a state where an upper case of the development device of FIG. 8 is removed. FIG. 10 is a sectional view of the process cartridge according to the present invention. FIG. 11 is an exploded perspective view of a part of the development device of FIG. 8. FIG. 12 is a sectional view of a magnetic carrier contained in a developer used in the development device of FIG. 8.

The development device 4 is provided with a case 28, the developing roller 16 mentioned above, a first developer pool 41 and a second developer pool 42 as developer supplying units, and a first conveying screw 18, a second conveying screw 19, a developing doctor 17, and toner concentration detecting device 21, as shown in FIG. 8 and the like.

The case 28 is made of metal or a synthetic resin, shown in FIG. 10, has a hollow box shape with a L-shaped cross section, is formed capable of being divided into two in up and down directions, and accommodates each component member included in the development device 4 mentioned above. A preset space 281 into which a developer is put at the time of shipment is provided on the top face of the case 28. The first developer pool 41 is formed in a gutter shape with a U-shaped cross-section, and accommodates the developer and the first conveying screw 18 therein. The second developer pool 42 is formed in a gutter shape with a U-shaped cross-section in the same manner as the first developer pool 41, and accommodates the developer and the second conveying screw 19. The first developer pool 41 and the second developer pool 42 are communicated with each other on the respective both end portions.

The first conveying screw 18 is provided with a cored bar and a spiral blade formed around the cored bar. The first conveying screw 18 rotates around its axis center in the first developer pool 41 so that the first conveying screw 18 conveys a developer from one end portion towards the other end portion in the longitudinal direction while supplying the developer in the first developer pool 41 to the developing roller 16. The second conveying screw 19 is provided with a cored bar and a spiral blade formed around the cored bar in the same manner as the first conveying screw 18. The second conveying screw 19 rotates around its axis center in the second developer pool 42 so that the second conveying screw 19 conveys a developer from the other end portion towards one end portion in the longitudinal direction while agitating the developer in the second developer pool 42. In other words, these conveying screws circulate the developer between the first developer pool and the second developer pool.

As shown in FIG. 11, the developing doctor 17 is composed of a developing doctor base 171 and a developing doctor assistance 172 made of a magnetic member. The developing doctor base 171 is fixed to the case 28 so as to face the developing roller 16 with a predetermined interval. It is common that the developing doctor base 171 is required to be made of a non-magnetic member, and have a certain thickness (about 1.5 to 2 mm) and straightness of about 0.05 mm on the tip portion thereof. This is because the developing doctor base 171 functions so that the developer quantity on the outer circumferential face of the developing roller 16 is regulated to be in a certain fixed quantity, and the developing doctor base 171 receives the developer pressure when the developer is regulated.

The developing doctor assistance 172 functions to make up for electrification of the toner conveyed in a developing region, and is usually composed of a sheet metal (about 0.2 mm) much thinner than the developing doctor base 171. Since the toner electrostatic property needs to be uniform in the longitudinal direction, these parts must be maintained with sufficient accuracy and are integrated by spot welding, caulking, or the like, so that the positional relation between these parts is arranged so as to have a fixed distance from the developing roller 16. In the example shown in the drawing, the developing doctor is located below with respect to the center (center of the axis) of the developing roller 16. Inside the side plate in front and in rear of the case 28, a magnetic plate 27 for preventing the developer from being scattered from both the end portions of the developing roller 16 is attached.

The toner concentration detecting device 21 is a sensor for measuring concentration of a developer in the developer supplying unit. Toner is suitably supplied to the second developer pool 42 from a toner housing unit in accordance with the concentration of the developer measured by the toner concentration detecting device 21.

As a developer of such the development device 4, a two component developer containing toner and a magnetic carrier is used. Toner is composed of spherical particulates manufactured by an emulsion polymerization method or a suspension polymerization method. Furthermore, toner may be obtained by grinding a lump composed of a synthetic resin with various dye or paints being mixed and distributed. The average particle diameter of toner is set at 3 μm to 7 μm.

A magnetic carrier 135 is provided with a core material 136, a resin coating film 137 that covers the outer surface of the core material 136, and alumina particles (large particles) 138 distributed on the rosin coating film 137 as shown in FIG. 12. The core material 136 is composed of a ferrite as a magnetic material and is formed in a spherical shape. The resin coating film 137 covers the whole outer surface of the core material 136. The resin coating film 137 contains a resin component in which a thermoplastic resin, such as acrylics, and a melamine resin are cross-linked, and a charging adjuster. The resin coating film 137 has elasticity and strong adhesive strength. The alumina particle 138 is formed with the outer diameter thereof larger than the thickness of the resin coating film 137. The alumina particle 138 is held by the strong adhesive strength of the resin coating film 137. The alumina particle 138 is projected from the resin coating film 137 to the outer circumferential face side of the magnetic carrier 135. The average particle diameter of the magnetic carrier 135 is set at 20 μm to 50 μm. The development device 4 can develop an image temporally stabilized and excellent in granularity by using such developer.

As mentioned above, according to the present invention, the development device 4 is provided with the developing roller 16 mentioned above according to the present invention. Therefore, it is possible to provide a development device that can prevent the entrainment of a developer and thus can obtain an image with uniform concentration.

Next, one embodiment of the process cartridge according to the present invention is described with reference to FIG. 10.

A process cartridge 60 includes: a cartridge case (not shown); the photoreceptor body 1 as a latent image carrier; an electrifying roller 2 as electrifying device; a photoreceptor body cleaning blade 9 as cleaning device; and the development device 4 mentioned above. The cartridge case (not shown) is detachable and attachable to a color copier 50 as an image forming apparatus (described later), and accommodates the photoreceptor body 1, the electrifying roller 2, the photoreceptor body cleaning blade 9, and the development device 4.

The electrifying roller 2 uniformly electrifies the outer circumferential face of the photoreceptor body 1. The photoreceptor body 1 is spaced with respect to the developing roller 16 of the development device 4. A developing region is formed in the space between the photoreceptor body 1 and the developing roller 16. The photoreceptor body 1 is formed in a cylindrical shape or a tubular shape so as to be rotatable around its axis. An electrostatic latent image is formed on the outer circumferential face of the photoreceptor body 1 by the corresponding laser writing unit. The electrostatic latent image formed and carried on the outer circumferential face is adsorbed and developed by the developer (toner) supplied by the development device 4. The photoreceptor body 1 transfers the toner image thus obtained to an intermediate transfer belt 5 (described later). The photoreceptor body cleaning blade 9 removes the transfer residual toner remained on the outer surface of the photoreceptor body 1 after the toner image is transferred to the intermediate transfer belt 5.

As mentioned above, according to the present invention, the process cartridge 60 is provided with the development device 4 mentioned above according to the present invention. Therefore, it is possible to provide a process cartridge that can prevent the entrainment of a developer and thus can obtain an image with uniform concentration.

Figure 13:
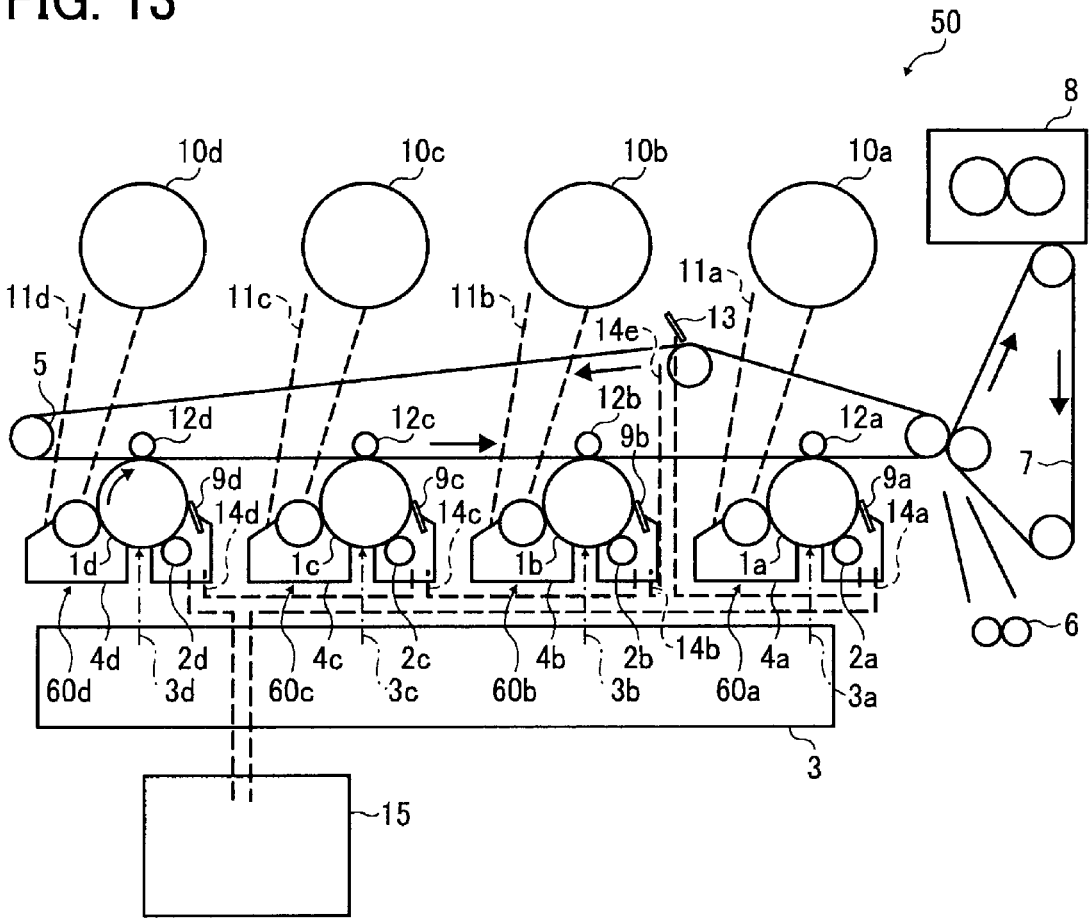
FIG. 13 is a schematic diagram of a color copier according to the present invention.

Next, a color copier which is one embodiment of the image forming apparatus according to the present invention is described with reference to FIG. 13. FIG. 13 is a schematic diagram of the color copier according to the present invention.

The color copier 50 is a so-called tandem type including multiple photoreceptor bodies (latent image carriers) arranged in parallel each having a development device, forms monochromatic toner images of yellow (a), magenta (b), cyan (c), and black (d) on the respective photoreceptor bodies, and transfers those monochromatic toner images to the intermediate transfer belt subsequently to record a composite color image on transfer paper. Units or component members thereof that correspond to the colors of yellow, magenta, cyan, and black are indicated below by attaching a, b, c, and d to the end of the reference numerals respectively.

The color copier 50 includes process cartridges 60 corresponding to the above-mentioned respective colors, and the intermediate transfer belt 5. Multiple photoreceptor bodies 1*a* to 1*d* included in the respective process cartridges 60*a* to 60*d* are arranged so as to oppose to the spreading portion of the intermediate transfer belt 5. A laser writing unit 3 as writing device writes the photoreceptor bodies 1*a* to 1*d* uniformly electrified by electrifying rollers 2*a* to 2*d*, which are electrifying device (writing positions 3*a* to 3*d*) so that electrostatic latent images are formed optically. Development devices 4*a* to 4*d* develops the electrostatic latent images to form visible images (toner images), which are composed of toner, are formed on the photoreceptor bodies 1*a* to 1*d*.

Primary transfer rollers 12*a* to 12*d* as intermediate transfer belt transfer device sequentially overlap and transfer the toner images, formed on the respective photoreceptor bodies 1*a* to 1*d*, on the intermediate transfer belt 5. A paper transfer belt 7 as paper transfer device transfers the toner image on the intermediate transfer belt 5 to the transfer paper as a recording medium conveyed through a resist roller pair 6. The paper transfer belt 7 conveys the toner image transferred on the transfer paper to fixing device 8 to be fixed on the transfer paper by heat. The transfer paper with the toner image being fixed thereto is discharged on a discharge tray or the like (not shown).

Photoreceptor body cleaning blades 9*a* to 9*d* scrape off the untransferred toner on the photoreceptor bodies 1*a* to 1*d* that is not transferred on the intermediate transfer belt 5 from the respective photoreceptor bodies. The residual charges on the respective photoreceptor bodies are eliminated by charge eliminating device (not shown), and the photoreceptor bodies 1*a* to 1*d* prepare for the next imaging operation.

The untransferred toner scraped off by the photoreceptor body cleaning blades 9*a* to 9*d* is passed through collected toner conveying paths 14*a* to 14*d*, and is housed in a waste toner housing container 15. Furthermore, the untransferred toner and a pattern image for process control on the intermediate transfer belt 5 are scrapped off by an intermediate transfer cleaning blade 13 from the intermediate transfer belt 5, and are passed through a collected toner conveying path 14*e* and are housed in the waste toner housing container 15 in the same manner.

New toner (unused toner) is supplied to the above-mentioned development devices 4*a* to 4*d*. Toner replenishing devices 10*a* to 10*d* supply the new toner filled with a toner cartridge (toner bottle) to toner hopper units 11*a* to 11*d* as toner housing units on the rear side of the main body of the color copier 50 (at the back side in FIG. 13). If the toner concentration detecting device 21 in each development device 4 determines that the toner concentration in each development device is low, a toner replenishing screw (not shown) in each toner hopper is rotated, and a proper quantity of toner is supplied to each development device 4 from the inside of each toner hopper. A toner presence detection sensor (not shown) in the toner hopper detects the toner residue of the toner bottle. More specifically, if the sensor detects that the toner is not present, the sensor requires supply of toner to the toner replenishing devices 10*a* to 10*d*. Then, even the sensor requires for a predetermined time and does not detect that toner is present, the sensor determines that toner is not present.

As mentioned above, according to the present invention, the color copier 50 is provided with the process cartridge 60 (that is, the development device 4) mentioned above according to the present invention. Therefore, it is possible to provide a process cartridge that can prevent the entrainment of a developer and thus can obtain an image with uniform concentration.

Next, the inventors of the present invention produced multiple developing rollers 16 having different magnetic properties (that is, a half-value width of a magnetic flux density, or the like) of the agent separating pole P4 and the scooping pole P6, respectively, and built them into the color copier 50 mentioned above, and carried out concentration unevenness tests.

The magnet roller 25 of the developing roller 16 that was composed of an anisotropic strontium ferrite and an ethylene ethyl acrylate copolymer and was magnetized by using the magnetizing jig 500 (500A, 500B) mentioned above to the body part 30 formed in 16 mm of the outer diameter ϕ and 309 mm of the length was used. In detail, the magnetic poles P1 to P3 and P5 were magnetized by using the magnetizing jig 500B, and the magnetic pole P4 (agent separating pole) and the magnetic pole P6 (scooping pole) were magnetized by using the magnetizing jig 500A or 500B. The magnetic property of the developing roller 16 is measured by using an HGM-8900 type gauss meter manufactured by ADS Corporation. The measurement is performed by contacting the gauss meter against the outer circumferential face of the developing roller 16, and the magnetic flux density distribution (normal magnetic property) is obtained from the value converted the amount of gausses into voltage in the gauss meter. The half-value central angle uses a D cut face 29*a* of the cored bar 29 as a reference and follows the angle in the counter clockwise direction for the right side of the D cut face as 0°, as shown in FIG. 7.

In other words, in FIG. 7, when the D cut face 29*a* directs upward, the right of the D cut face 29*a* is 0°, the top thereof is 90°, the left thereof 180°, and the bottom thereof is 270°. Furthermore, the developing sleeve 26 of the developing roller 16 is made of aluminum A6063, and is formed with the outer diameter ϕ of 18 mm, with the internal diameter of 16.5 mm, and with the length of 326 mm, and the SWB mentioned above is subjected thereto as surface roughening processing to the outer circumferential face 26*a* thereof. The two component developer mentioned above having 35 μm of the average particle diameter of the magnetic carrier is used as a developer. The developing roller 16 shown in respective examples and respective comparative examples was incorporated into the color copier 50 mentioned above, a test solid image was printed, the concentration unevenness (void in the end portion) of the printed image was checked visually, and a determination was made based on the following references.

◇ image has no problem at all
○ image has no problem
Δ image has a little problem, but practically no trouble
x image has a problem Example 1

The agent separating pole P4 was formed by using the magnetizing jig 500A provided with the magnetizing yoke 520 in which the width at both the end portions of the top face 521 was formed narrower than the width at the central portion, and the center position of the width at both the end portions and the center position of the width at the central portion were provided on the same line as shown in FIG. 5B. The scooping pole P6 was formed by using the magnetizing jig 500B provided with the magnetizing yoke 520 in which the width at both the end portions of the top face 521 was identical to the width at the central portion as shown in FIG. 5A. As for the developing roller 16 having the magnetic poles thus formed therein, the following results were obtained: the half-value width was 35.0° of and the half-value central angle was 162.2°, of the magnetic flux density at the central portion of the agent separating pole P4; the half-value width was 34.6° and the half-value central angle was 163.3°, of the magnetic flux density at one end portion thereof (an end portion on the front side of FIG. 7); and the half-value width was 33.8° and the half-value central angle was 162.8°, of the magnetic flux density at the other end portion thereof (an end portion on the rear side of FIG. 7). The half-value width was 46.2° and the half-value central angle was 275.5°, of the magnetic flux density at the central portion of the scooping pole P6; the half-value width was 50.8° and the half-value central angle was 273.8°, of the magnetic flux density at one end portion thereof, and the half-value width was 47.6° and the half-value central angle was 274.8° of the magnetic flux density at the other end portion thereof. In other words, the agent separating pole P4 is formed so that the half-value width of the magnetic flux density at both the end portions is narrow, and the scooping pole P6 is formed so that the half-value width of the magnetic flux density at both the end portions is normal (the same as that of the central portion).

Example 2

The agent separating pole P4 was formed by using the magnetizing jig 500A provided with the magnetizing yoke 520 in which the width at both the end portions of the top face 521 was formed narrower than the width at the central portion, and the center position of the width at both the end portions was provided offset from the center position of the width of the central portion as shown in FIG. 5C. The scooping pole P6 was formed by using the magnetizing jig 500B provided with the magnetizing yoke 520 in which the width at both the end portions of the top face 521 was identical to the width at the central portion as shown in FIG. 5A. As for the developing roller 16 having the magnetic poles thus formed therein, the following results were obtained: the half-value width was 34.7° of and the half-value central angle was 162.3°, of the magnetic flux density at the central portion of the agent separating pole P4; the half-value width was 33.8° and the half-value central angle was 161.8°, of the magnetic flux density at one end portion thereof and the half-value width was 33.0° and the half-value central angle was 161.7°, of the magnetic flux density at the other end portion thereof. The half-value width was 45.9° and the half-value central angle was 275.5°, of the magnetic flux density at the central portion of the scooping pole P6; the half-value width was 49.7° and the half-value central angle was 274.1°, of the magnetic flux density at one end portion thereof and the half-value width was 47.6° and the half-value central angle was 275.0°, of the magnetic flux density at the other end portion thereof. In other words, the agent separating pole P4 is formed so that the half-value width of the magnetic flux density at both the end portions is narrow and the central portion thereof is close to the upstream side in the rotational direction of the developing sleeve 26, and the scooping pole P6 is formed so that the half-value width of the magnetic flux density at both the end portions is normal.

Example 3

The agent separating pole P4 was formed by using the magnetizing jig 5008 provided with the magnetizing yoke 520 in which the width at both the end portions of the top face 521 was identical to the width at the central portion as shown in FIG. 5A. The scooping pole P6 was formed by using the magnetizing jig 500A provided with the magnetizing yoke 520 in which the width at both the end portions of the top face 521 was formed narrower than the width of the central portion, and the center position of the width at both the end portions and the center position of the width at the central portion are provided on the same line as shown in FIG. 5B. As for the developing roller 16 having the magnetic poles thus formed therein, the following results were obtained: the half-value width was 35.6° of and the half-value central angle was 160.2°, of the magnetic flux density at the central portion of the agent separating pole P4; the half-value width was 37.8° and the half-value central angle was 161.0°, of the magnetic flux density at one end portion thereof; and the half-value width was 37.1° and the half-value central angle was 161.2°, of the magnetic flux density at the other end portion thereof. The half-value width was 46.5° and the half-value central angle was 275.3°, of the magnetic flux density at the central portion of the scooping pole P6; the half-value width was 46.0° and the half-value central angle was 273.7°, of the magnetic flux density at one end portion thereof, and the half-value width was 46.1° and the half-value central angle was 273.8° of the magnetic flux density at the other end portion thereof. In other words, the agent separating pole P4 is formed so that the half-value width of the magnetic flux density at both the end portions is normal, and the scooping pole P6 is formed so that the half-value width of the magnetic flux density at both the end portions is narrower.

Example 4

The agent separating pole P4 was formed by using the magnetizing jig 500B provided with the magnetizing yoke 520 in which the width at both the end portions of the top face 521 was identical to the width at the central portion as shown in FIG. 5A. The scooping pole P6 was formed by using the magnetizing jig 500A provided with the magnetizing yoke 520 in which the width at both the end portions of the top face 521 was formed narrower than the width at the central portion, and the center position of the width at both the end portions was provided offset from the center position of the width at the central portion as shown in FIG. 5C. As for the developing roller 16 having the magnetic poles thus formed therein, the following results were obtained: the half-value width was 34.9° of and the half-value central angle was 160.4°, of the magnetic flux density at the central portion of the agent separating pole P4; the half-value width was 38.2° and the half-value central angle was 160.8°, of the magnetic flux density at one end portion thereof and the half-value width was 36.8° and the half-value central angle was 161.1°, of the magnetic flux density at the other end portion thereof. The half-value width was 46.8° and the half-value central angle was 275.0°, of the magnetic flux density at the central portion of the scooping pole P6; the half-value width was 45.8° and the half-value central angle was 275.3°, of the magnetic flux density at one end portion thereof and the half-value width was 46.0° and the half-value central angle was 275.3°, of the magnetic flux density at the other end portion thereof. In other words, the agent separating pole P4 is formed so that the half-value width of the magnetic flux density at both the end portions is normal, and the scooping pole P6 is formed so that the half-value width of the magnetic flux density at both the end portions is narrower and the central portion thereof is close to the downstream side in the rotational direction of the developing sleeve 26.

Example 5

The agent separating pole P4 and the scooping pole P6 were formed by using the magnetizing jig 500A provided with the magnetizing yoke 520 in which the width at both the end portions of the top face 521 was formed narrower than the width of the central portion, and the center position of the width at both the end portions and the center position of the width of the central portion were provided on the same line as shown in FIG. 5B. As for the developing roller 16 having the magnetic poles thus formed therein, the following results were obtained: the half-value width was 32.9° of and the half-value central angle was 162.1°, of the magnetic flux density at the central portion of the agent separating pole P4; the half-value width was 32.4° and the half-value central angle was 163.3°, of the magnetic flux density at one end portion thereof, and the half-value width was 31.6° and the half-value central angle was 162.8°, of the magnetic flux density at the other end portion thereof. The half-value width was 45.9° and the half-value central angle was 275.4°, of the magnetic flux density at the central portion of the scooping pole P6; the half-value width was 45.2° and the half-value central angle was 273.7°, of the magnetic flux density at one end portion thereof; and the half-value width was 45.1° and the half-value central angle was 274.2° of the magnetic flux density at the other end portion thereof. In other words, the agent separating pole P4 and the scooping pole P6 are formed so that the half-value widths of the magnetic flux density at both the end portions are narrower.

Example 6

The agent separating pole P4 was formed by using the magnetizing jig 500A provided with the magnetizing yoke 520 in which the width at both the end portions of the top face 521 was formed narrower than the width of the central portion, and the center position of the width of both the end portions and the center position of the width of the central portion were provided on the same line as shown in FIG. 5B. The scooping pole P6 was formed by using the magnetizing jig 500A provided with the magnetizing yoke 520 in which the width at both the end portions of the top face 521 was formed narrower than the width at the central portion, and the center position of the width of both the end portions was provided offset from the center position of the width of the central portion as shown in FIG. 5C. As for the developing roller 16 having the magnetic poles thus formed therein, the following results were obtained: the half-value width was 33.4° of and the half-value central angle was 162.3°, of the magnetic flux density at the central portion of the agent separating pole P4; the half-value width was 32.7° and the half-value central angle was 163.0°, of the magnetic flux density at one end portion thereof, and the half-value width was 32.0° and the half-value central angle was 162.7°, of the magnetic flux density at the other end portion thereof. The half-value width was 46.0° and the half-value central angle was 275.4°, of the magnetic flux density at the central portion of the scooping pole P6; the half-value width was 44.9° and the half-value central angle was 275.5°, of the magnetic flux density at one end portion thereof and the half-value width was 45.0° and the half-value central angle was 275.6°, of the magnetic flux density at the other end portion thereof. In other words, the agent separating pole P4 is formed so that the half-value width of the magnetic flux density at both the end portions may become narrower, and the scooping pole P6 is formed so that the half-value width of the magnetic flux density at both the end portions is narrower and the central portion thereof is close to the downstream side in the rotational direction of the developing sleeve 26.

Example 7

The agent separating pole P4 was formed by using the magnetizing jig 500A provided with the magnetizing yoke 520 in which the width of both the end portions of the top face 521 was formed narrower than the width at the central portion, and the center position at the width of both the end portions was provided offset from the center position of the width at the central portion as shown in FIG. 5C. The scooping pole P6 was formed by using the magnetizing jig 500A provided with the magnetizing yoke 520 in which the width at both the end portions of the top face 521 was formed narrower than the width at the central portion, and the center position of the width at both the end portions and the center position of the width at the central portion were provided on the same line as shown in FIG. 5B. As for the developing roller 16 having the magnetic poles thus formed therein, the following results were obtained: the half-value width was 33.0° of and the half-value central angle was 162.0°, of the magnetic flux density at the central portion of the agent separating pole P4; the half-value width was 32.5° and the half-value central angle was 161.0°, of the magnetic flux density at one end portion thereof; and the half-value width was 31.8° and the half-value central angle was 161.8°, of the magnetic flux density at the other end portion thereof. The half-value width was 46.2° and the half-value central angle was 274.0°, of the magnetic flux density at the central portion of the scooping pole P6; the half-value width was 45.5° and the half-value central angle was 272.2°, of the magnetic flux density at one end portion thereof and the half-value width was 45.3° and the half-value central angle was 273.6° of the magnetic flux density at the other end portion thereof. In other words, the agent separating pole P4 is formed so that the half-value width of the magnetic flux density at both the end portions is narrower and the central portion thereof is close to the upstream side in the rotational direction of the developing sleeve 26, and the scooping pole P6 is formed so that the half-value width of the magnetic flux density at both the end portions is narrower.

Example 8

The agent separating pole P4 and the scooping pole P6 were formed by using the magnetizing jig 500A provided with the magnetizing yoke 520 in which the width at both the end portions of the top face 521 was formed narrower than the width of the central portion, and the center position of the width at both the end portions was provided offset from the center position of the width of the central portion as shown in FIG. 5C. As for the developing roller 16 having the magnetic poles thus formed therein, the following results were obtained: the half-value width was 33.3° of and the half-value central angle was 161.8°, of the magnetic flux density at the central portion of the agent separating pole P4; the half-value width was 32.0° and the half-value central angle was 161.5°, of the magnetic flux density at one end portion thereof; and the half-value width was 31.7° and the half-value central angle was 161.4°, of the magnetic flux density at the other end portion thereof. The half-value width was 46.0° and the half-value central angle was 274.0°, of the magnetic flux density at the central portion of the scooping pole P6; the half-value width was 45.5° and the half-value central angle was 274.7°, of the magnetic flux density at one end portion thereof; and the half-value width was 44.9° and the half-value central angle was 274.6°, of the magnetic flux density at the other end portion thereof. In other words, the agent separating pole P4 is formed so that the half-value width of the magnetic flux density at both the end portions is narrower and the central portion thereof is close to the upstream side in the rotational direction of the developing sleeve 26, and the scooping pole P6 is formed so that the half-value width of the magnetic flux density at both the end portions is narrower and the central portion thereof is close to the downstream side in the rotational direction of the developing sleeve 26.

Comparative Example 1

The agent separating pole P4 and the scooping pole P6 were formed by using the magnetizing jig 500B provided with the magnetizing yoke 520 in which the width at both the end portions of the top face 521 was identical to the width at the central portion as shown in FIG. 5A. As for the developing roller 16 having the magnetic poles thus formed therein, the following results were obtained: the half-value width was 36.0° of, the half-value central angle was 160.2°, and the peak magnetic flux density was 44.8 mT, of the magnetic flux density at the central portion of the agent separating pole P4; the half-value width was 38.0°, the half-value central angle was 161.0°, and the peak magnetic flux density was 48.0 mT, of the magnetic flux density at one end portion thereof and the half-value width was 37.1°, the half-value central angle was 161.2°, and the peak magnetic flux density was 48.7 mT, of the magnetic flux density at the other end portion thereof. The half-value width was 46.2°, the half-value central angle was 275.3°, and the peak magnetic flux density was 63.3 mT, of the magnetic flux density at the central portion of the scooping pole P6; the half-value width was 47.6°, the half-value central angle was 273.8°, and the peak magnetic flux density was 68.0 mT, of the magnetic flux density at one end portion thereof and the half-value width was 45.6°, the half-value central angle was 273.6°, and the peak magnetic flux density was 67.8 mT, of the magnetic flux density at the other end portion thereof. In other words, the agent separating pole P4 and the scooping pole P6 are formed so that the half-value widths of the magnetic flux density at both the end portions are normal.

Comparative Example 2

The agent separating pole P4 was formed by using the magnetizing jig 500A provided with the magnetizing yoke 520 in which the width at both the end portions of the top face 521 was identical to the width at the central portion, and the distance between both the end portions of the top face 521 and an outer circumferential face 25*a* of the magnet roller 25 was made larger than the distance between the central portion of the top face 521 and the outer circumferential face 25*a* of the magnet roller 25 as shown in FIG. 5A. The scooping pole P6 was formed by using the magnetizing jig 500B provided with the magnetizing yoke 520 in which the width at both the end portions of the top face 521 was identical to the width at the central portion as shown in FIG. 5A. As for the developing roller 16 having the magnetic poles thus formed therein, the following results were obtained: the half-value width was 36.1°, the half-value central angle was 160.0°, and the peak magnetic flux density was 46.0 mT, of the magnetic flux density at the central portion of the agent separating pole P4; the half-value width was 38.5°, the half-value central angle was 161.5°, and the peak magnetic flux density was 45.5 mT, of the magnetic flux density at one end portion thereof; and the half-value width was 38.0°, the half-value central angle was 161.5°, and the peak magnetic flux density was 46.0 mT, of the magnetic flux density at the other end portion thereof. The half-value width was 46.0°, the half-value central angle was 275.4°, and the peak magnetic flux density was 63.5 mT, of the magnetic flux density at the central portion of the scooping pole P6, the half-value width was 48.0°, the half-value central angle was 274.0°, and the peak magnetic flux density was 67.7 mT, of the magnetic flux density at one end portion thereof; and the half-value width was 45.6°, the half-value central angle was 273.8°, and the peak magnetic flux density was 67.5 mT, of the magnetic flux density at the other end portion thereof. In other words, the agent separating pole P4 is formed so that the deviation of the peak magnetic flux densities between the central portion and both the end portions is small, and the scooping pole P6 is formed so that the half-value width of the magnetic flux density at both the end portions is normal.

Comparative Example 3

The agent separating pole P4 was formed by using the magnetizing jig 500B provided with the magnetizing yoke 520 in which the width at both the end portions of the top face 521 was identical to the width at the central portion as shown in FIG. 5A. The scooping pole P6 was formed by using the magnetizing jig 500B provided with the magnetizing yoke 520 in which the width at both the end portions of the top face 521 was identical to the width at the central portion, and the distance between both the end portions of the top face 521 and the outer circumferential face 25*a* of the magnet roller 25 was made larger than the distance between the central portion of the top face 521 and the outer circumferential face 25*a* of the magnet roller 25 as shown in FIG. 5A. As for the developing roller 16 having the magnetic poles thus formed therein, the following results were obtained: the half-value width was 36.2°, the half-value central angle was 160.7°, and the peak magnetic flux density was 45.2 mT, of the magnetic flux density at the central portion of the agent separating pole P4; the half-value width was 38.0°, the half-value central angle was 161.7°, and the peak magnetic flux density was 48.0 mT, of the magnetic flux density at one end portion thereof, and the half-value width was 37.1°, the half-value central angle was 162.1°, and the peak magnetic flux density was 48.7 mT, of the magnetic flux density at the other end portion thereof. The half-value width was 46.1°, the half-value central angle was 275.3°, and the peak magnetic flux density was 63.3 mT, of the magnetic flux density the central portion of the scooping pole P6; the half-value width was 48.5°, the half-value central angle was 274.2°, and the peak magnetic flux density was 63.9 mT, of the magnetic flux density in one end portion thereof; and the half-value width was 49.0°, the half-value central angle was 274.0°, and the peak magnetic flux density was 63.1 mT, of the magnetic flux density at the other end portion thereof. In other words, the agent separating pole P4 is formed so that the half-value width of the magnetic flux density at both the end portions is normal, and the scooping pole P6 is formed so that the deviation of the peak magnetic flux densities between the central portion and both the end portions is small.

Comparative Example 4

The agent separating pole P4 and the scooping pole P6 were formed by using the magnetizing jig 500A provided with the magnetizing yoke 520 in which the width at both the end portions of the top face 521 was identical to the width at the central portion, and the distance between both the end portions of the top face 521 and the outer circumferential face 25*a* of the magnet roller 25 was made larger than the distance between the central portion of the top face 521 and the outer circumferential face 25*a* of the magnet roller 25 as shown in FIG. 5A. As for the developing roller 16 having the magnetic poles thus formed therein, the following results were obtained: the half-value width was 36.1°, the half-value central angle was 160.3°, and the peak magnetic flux density was 45.2 mT, of the magnetic flux density at the central portion of the agent separating pole P4; the half-value width was 38.6°, the half-value central angle was 161.8°, and the peak magnetic flux density was 45.2 mT, of the magnetic flux density at one end portion thereof; and the half-value width was 37.8°, the half-value central angle was 162.3°, and the peak magnetic flux density was 45.5 mT, of the magnetic flux density at the other end portion thereof. The half-value width was 46.3°, the half-value central angle was 275.3°, and the peak magnetic flux density was 63.3 mT, of the magnetic flux density at the central portion of the scooping pole P6; the half-value width was 48.8°, the half-value central angle was 274.9°, and the peak magnetic flux density was 63.9 mT, of the magnetic flux density at one end portion thereof; and the half-value width was 48.8°, the half-value central angle was 273.5°, and the peak magnetic flux density was 63.1 mT, of the magnetic flux density at the other end portion thereof. In other words, the agent separating pole P4 and the scooping pole P6 are formed so that the deviation of the peak magnetic flux densities between the central portion and both the end portions is small.

The results of the concentration unevenness test carried out in the above respective examples and comparative examples are shown in Table 1.

TABLE 1

| | Property of magnetic flux density at both ends | | Judgment (Void at end portion) | Left void width [mm] |
|---|---|---|---|---|
| | Agent separating pole P4 | Scooping pole P6 | | |
| Example 1 | Half-value width is narrow | Normal | Δ | 4 |
| Example 2 | Half-value width is narrow and close to upstream | Normal | ○ | 4 |
| Example 3 | Normal | Half-value width is narrow | Δ | 3 |
| Example 4 | Normal | Half-value width is narrow and close to downstream | ○ | 3 |
| Example 5 | Half-value width is narrow | Half-value width is narrow | ○ | 3 |
| Example 6 | Half-value width is narrow | Half-value width is narrow and close to downstream | ○ | 2 |
| Example 7 | Half-value width is narrow and close to upstream | Half-value width is narrow | ○ | 1 |
| Example 8 | Half-value width is narrow and close to upstream | Half-value width is narrow and close to downstream | ◇ | 0 |
| Comparative example 1 | Normal | Normal | x | 5 |
| Comparative example 2 | Deviation of the peak magnetic flux densities is small | Normal | x | 5 |
| Comparative example 3 | Normal | Deviation of the peak magnetic flux densities is small | x | 5 |
| Comparative example 4 | Deviation of the peak magnetic flux densities is small | Deviation of the peak magnetic flux densities is small | x | 5 |

◇ image has no problem at all
○ image has no problem
Δ image has a problem, but practically no trouble
x image has a problem The test result of the concentration unevenness in Table 1 indicates that when the half-value width of the magnetic flux density at both the end portions of at least one magnetic pole of the agent separating pole P4 and the scooping pole P6 is formed narrower than the half-value width at the central portion thereof, the void at the end portion can be prevented and the image with uniform concentration can be obtained (Examples 1 to 8, and Comparison example 1). In addition, it is found that at both the end portions of the agent separating pole P4, by not only making the half-value width of the magnetic flux density narrower than that of the central portion, but providing the agent separating pole P4 close to the upstream side of the rotational direction of the developing sleeve 26, the void at the end portion can be further prevented (examples 1 and 2). Additionally, it is found that at both the end portions of the scooping pole P6, by not only making the half-value width of the magnetic flux density narrower than that of the central portion, but providing the scooping pole P6 close to the downstream side in the rotational direction of the developing sleeve 26, the void at the end portion can be further prevented (examples 3 and 4). Moreover, it is found that by making the half-value widths of the magnetic flux density at the respective both end portions of the agent separating pole P4 and the scooping pole P6 narrower than that of the central portion, an image void can be further prevented (examples 5-7). Furthermore, it is found that at both the end portions of the agent separating pole P4, by making the half-value width of the magnetic flux density narrower than that of the central portion and providing the agent separating pole P4 close to the upstream side of the rotational direction of the developing sleeve 26, and at both the end portions of the scooping pole P6, by making the half-value width of the magnetic flux density narrower than that of the central portion and by providing the scooping pole P6 close to the downstream side of the rotational direction of the developing sleeve 26, the void in the end portion can be further prevented (example 8). It is found that even if the deviation of the magnetic flux density at the central portion and both the end portions of at least one magnetic pole of the agent separating pole P4 and the scooping pole P6 is made small, there is no effect in the void at the end portion (comparative examples 1-4). It is found that when the determination (evaluation) of the void at the end portion is high, the omission width of the image at the end portion is also small.

From the above-mentioned concentration unevenness test result, according to the present invention, the half-value width of the magnetic flux density at both the end portions of at least one magnetic pole of the agent separating pole P4 and the scooping pole P6 is formed narrower than half-value width of the magnetic flux density at the central portion of this magnetic pole, so that the disengagement property (agent separation property) of the developer at both the end portions of the agent separating pole P4 of the developing roller 16 can be improved, or the developer can be prevented from re-adsorbing continuously at both the end portions of the scooping pole P6 of the developing roller 16. Therefore, it is found that the entrainment of a developer can be prevented, and an image with uniform concentration without the void in the end portion can be obtained.

Tables that summarize magnetic force characteristic values (the peak magnetic flux density (Table 2), the half-value central angle (Table 3), and the half-value width of the magnetic flux density (Table 4)) of multiple magnetic poles in the respective examples and comparative examples mentioned above are shown below as reference data.

TABLE 2

| | Peak magnetic flux density (mT) | | | | | | | | | | | | | | | | | |
|---|---|---|---|---|---|---|---|---|---|---|---|---|---|---|---|---|---|---|
| | One end portion | | | | | | Central portion | | | | | | The other end portion | | | | | |
| | P1 | P2 | P3 | P4 | P5 | P6 | P1 | P2 | P3 | P4 | P5 | P6 | P1 | P2 | P3 | P4 | P5 | P6 |
| Example 1 | 104.8 | 65.8 | 76.0 | 43.7 | 3.8 | 68.6 | 105.0 | 67.4 | 77.5 | 45.9 | 1.7 | 65.1 | 108.2 | 69.0 | 73.8 | 44.8 | 3.5 | 68.7 |
| Example 2 | 105.0 | 65.7 | 75.7 | 44.0 | 3.5 | 67.9 | 105.0 | 67.4 | 77.5 | 45.7 | 1.7 | 64.7 | 106.9 | 68.7 | 74.4 | 44.6 | 3.4 | 68.5 |
| Example 3 | 109.7 | 69.5 | 72.2 | 48.0 | 3.6 | 63.8 | 110.2 | 67.7 | 73.1 | 44.8 | 1.5 | 63.3 | 111.9 | 70.4 | 72.7 | 48.7 | 3.6 | 63.8 |
| Example 4 | 109.7 | 70.5 | 71.8 | 48.3 | 3.1 | 64.1 | 110.2 | 67.7 | 73.1 | 45.2 | 1.5 | 63.3 | 111.9 | 70.4 | 72.7 | 49.0 | 3.2 | 64.2 |
| Example 5 | 108.4 | 76.4 | 78.7 | 45.6 | 3.4 | 63.7 | 106.8 | 74.4 | 80.5 | 46.1 | 2.4 | 64.2 | 110.8 | 77.9 | 79.9 | 46.5 | 3.1 | 64.0 |
| Example 6 | 109.5 | 76.0 | 77.8 | 45.5 | 3.5 | 63.7 | 106.9 | 74.9 | 80.2 | 45.9 | 2.3 | 63.8 | 111.2 | 78.1 | 80.1 | 46.3 | 3.2 | 63.7 |
| Example 7 | 109.8 | 76.2 | 76.9 | 45.7 | 3.6 | 63.7 | 107.0 | 75.2 | 70.7 | 45.9 | 2.4 | 64.0 | 112.2 | 78.3 | 80.2 | 46.5 | 3.5 | 64.1 |
| Example 8 | 108.9 | 75.9 | 78.2 | 45.9 | 3.4 | 63.5 | 105.8 | 74.3 | 80.1 | 46.2 | 2.8 | 63.9 | 111.7 | 77.7 | 79.7 | 46.2 | 3.3 | 64.3 |
| Comparative example 1 | 109.7 | 69.5 | 72.2 | 48.0 | 3.0 | 68.0 | 110.2 | 67.7 | 73.1 | 44.8 | 1.5 | 63.3 | 111.9 | 70.4 | 72.7 | 48.7 | 3.5 | 67.8 |
| Comparative example 2 | 107.5 | 69.4 | 72.5 | 45.5 | 3.1 | 67.7 | 108.0 | 67.4 | 73.0 | 45.0 | 1.5 | 63.5 | 112.4 | 69.8 | 72.6 | 46.0 | 3.6 | 67.5 |
| Comparative example 3 | 109.2 | 69.2 | 72.3 | 48.0 | 3.2 | 63.9 | 109.2 | 67.7 | 72.5 | 45.2 | 1.5 | 63.3 | 112.4 | 69.4 | 71.9 | 48.7 | 3.7 | 63.1 |
| Comparative example 4 | 108.5 | 68.9 | 71.9 | 45.2 | 3.3 | 63.9 | 109.0 | 68.0 | 72.7 | 45.2 | 1.5 | 63.3 | 111.4 | 70.0 | 73.3 | 45.5 | 3.1 | 63.1 |

TABLE 3

| | Half-value center angle (°) | | | | | | | | | | | | | | | | | |
|---|---|---|---|---|---|---|---|---|---|---|---|---|---|---|---|---|---|---|
| | One end portion | | | | | | Central portion | | | | | | The other end portion | | | | | |
| | P1 | P2 | P3 | P4 | P5 | P6 | P1 | P2 | P3 | P4 | P5 | P6 | P1 | P2 | P3 | P4 | P5 | P6 |
| Example 1 | 351.0 | 47.1 | 107.9 | 163.3 | — | 273.8 | 350.7 | 47.1 | 107.6 | 162.2 | — | 275.5 | 350.3 | 45.7 | 107.0 | 162.8 | — | 274.8 |
| Example 2 | 350.8 | 47.1 | 107.5 | 161.8 | — | 274.1 | 351.0 | 46.7 | 107.5 | 162.3 | — | 275.5 | 350.6 | 45.6 | 106.7 | 161.7 | — | 275.0 |
| Example 3 | 351.2 | 44.6 | 105.0 | 161.0 | — | 273.7 | 351.5 | 44.6 | 104.8 | 160.2 | — | 275.3 | 351.0 | 44.0 | 105.0 | 161.2 | — | 273.8 |
| Example 4 | 351.0 | 44.6 | 104.7 | 160.8 | — | 273.3 | 351.3 | 45.6 | 104.9 | 160.4 | — | 275.0 | 350.7 | 44.0 | 104.6 | 161.1 | — | 275.3 |
| Example 5 | 350.7 | 47.1 | 108.0 | 163.3 | — | 273.7 | 350.9 | 47.1 | 107.9 | 162.1 | — | 275.4 | 350.7 | 45.5 | 106.8 | 162.8 | — | 274.2 |
| Example 6 | 350.6 | 47.1 | 107.6 | 163.0 | — | 275.5 | 351.0 | 47.1 | 107.7 | 162.3 | — | 275.4 | 350.4 | 45.7 | 106.7 | 162.7 | — | 275.6 |
| Example 7 | 351.2 | 45.7 | 105.6 | 161.0 | — | 272.2 | 351.2 | 46.7 | 106.7 | 162.0 | — | 274.0 | 350.4 | 45.2 | 106.1 | 161.8 | — | 273.6 |
| Example 8 | 351.4 | 45.7 | 106.0 | 161.5 | — | 274.7 | 351.4 | 47.0 | 106.9 | 161.8 | — | 274.0 | 350.2 | 45.3 | 105.6 | 161.4 | — | 274.6 |
| Comparative example 1 | 351.0 | 44.6 | 104.7 | 161.0 | — | 273.8 | 351.4 | 44.6 | 106.9 | 160.2 | — | 275.3 | 350.7 | 44.0 | 104.6 | 161.2 | — | 273.6 |
| Comparative example 2 | 350.8 | 44.8 | 104.8 | 161.5 | — | 274.0 | 351.4 | 44.6 | 106.9 | 160.0 | — | 275.4 | 351.0 | 44.3 | 105.0 | 161.5 | — | 273.6 |
| Comparative example 3 | 350.7 | 44.3 | 104.8 | 161.7 | — | 274.2 | 351.4 | 44.6 | 106.9 | 160.7 | — | 275.3 | 350.9 | 44.5 | 104.9 | 162.1 | — | 274.0 |
| Comparative example 4 | 350.5 | 44.7 | 104.9 | 161.8 | — | 274.9 | 351.4 | 44.6 | 106.9 | 160.3 | — | 275.3 | 351.1 | 44.1 | 105.1 | 162.3 | — | 273.5 |

TABLE 4

| | Half-value width (°) | | | | | | | | | | | | | | | | | |
|---|---|---|---|---|---|---|---|---|---|---|---|---|---|---|---|---|---|---|
| | One end portion | | | | | | Central portion | | | | | | The other end portion | | | | | |
| | P1 | P2 | P3 | P4 | P5 | P6 | P1 | P2 | P3 | P4 | P5 | P6 | P1 | P2 | P3 | P4 | P5 | P6 |
| Example 1 | 40.0 | 39.8 | 39.4 | 34.6 | — | 50.8 | 40.2 | 39.8 | 39.6 | 35.0 | — | 46.2 | 39.4 | 39.8 | 40.1 | 33.8 | — | 47.6 |
| Example 2 | 39.7 | 39.7 | 39.0 | 33.8 | — | 49.7 | 40.0 | 39.8 | 39.3 | 34.7 | — | 45.9 | 39.1 | 39.4 | 39.5 | 33.0 | — | 47.6 |
| Example 3 | 39.7 | 39.2 | 40.0 | 37.8 | — | 46.0 | 39.5 | 39.3 | 40.2 | 35.6 | — | 46.5 | 39.8 | 39.8 | 40.3 | 37.1 | — | 46.1 |
| Example 4 | 39.9 | 39.1 | 40.1 | 38.2 | — | 45.8 | 39.7 | 39.7 | 40.3 | 34.9 | — | 46.8 | 39.5 | 39.6 | 40.2 | 36.8 | — | 46.0 |
| Example 5 | 38.9 | 39.2 | 40.2 | 32.4 | — | 45.2 | 39.6 | 39.5 | 40.0 | 32.9 | — | 45.9 | 39.1 | 39.8 | 40.9 | 31.6 | — | 45.1 |
| Example 6 | 39.2 | 39.4 | 40.4 | 32.7 | — | 44.9 | 39.9 | 40.0 | 40.1 | 33.4 | — | 46.0 | 39.7 | 39.6 | 41.0 | 32.0 | — | 45.0 |
| Example 7 | 38.0 | 39.7 | 40.5 | 32.5 | — | 45.5 | 39.7 | 39.7 | 40.3 | 33.0 | — | 46.2 | 39.2 | 39.9 | 41.2 | 31.8 | — | 45.3 |

TABLE 4-continued

| | Half-value width (°) | | | | | | | | | | | | | | | | | |
|---|---|---|---|---|---|---|---|---|---|---|---|---|---|---|---|---|---|---|
| | One end portion | | | | | | Central portion | | | | | | The other end portion | | | | | |
| | P1 | P2 | P3 | P4 | P5 | P6 | P1 | P2 | P3 | P4 | P5 | P6 | P1 | P2 | P3 | P4 | P5 | P6 |
| Example 8 | 39.2 | 39.5 | 40.9 | 32.0 | — | 45.5 | 39.6 | 39.6 | 40.2 | 33.3 | — | 46.0 | 39.3 | 40.0 | 41.3 | 31.7 | — | 44.9 |
| Comparative example 1 | 38.6 | 38.8 | 40.3 | 38.0 | — | 47.6 | 38.6 | 38.8 | 40.6 | 36.0 | — | 46.2 | 38.5 | 38.8 | 40.8 | 37.1 | — | 45.6 |
| Comparative example 2 | 39.0 | 39.0 | 40.2 | 38.5 | — | 48.0 | 38.7 | 38.9 | 40.7 | 36.1 | — | 46.0 | 38.6 | 38.9 | 41.0 | 38.0 | — | 45.6 |
| Comparative example 3 | 38.9 | 38.9 | 40.2 | 38.0 | — | 48.5 | 38.7 | 38.8 | 40.6 | 36.2 | — | 46.1 | 38.4 | 38.9 | 40.9 | 37.1 | — | 49.0 |
| Comparative example 4 | 38.8 | 38.8 | 40.3 | 38.6 | — | 48.8 | 38.6 | 38.9 | 40.6 | 36.1 | — | 46.3 | 38.5 | 38.8 | 40.8 | 37.8 | — | 48.8 |

Figure 14:
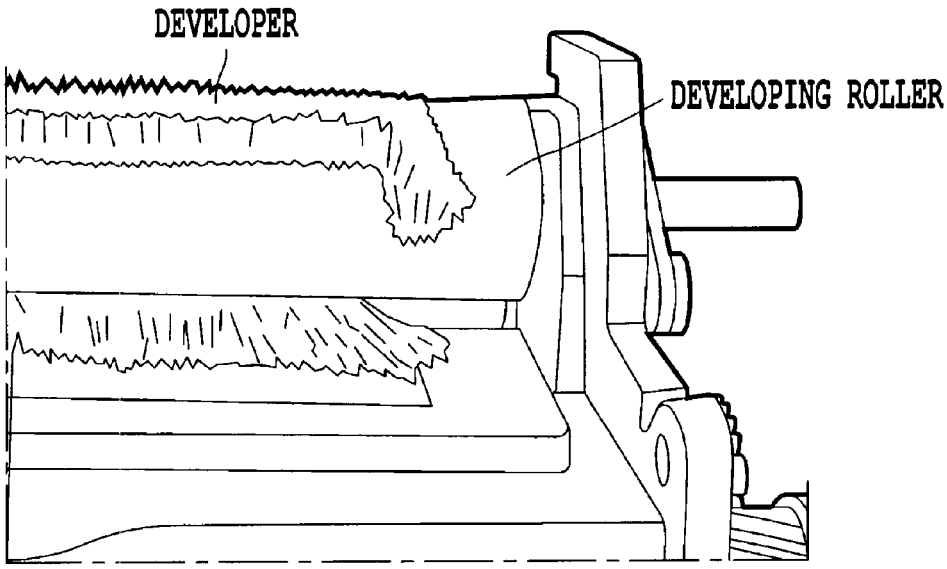
FIG. 14 is a view showing an adsorbed state of the developer at an end portion of the developing roller according to the present invention.
Figure 15:
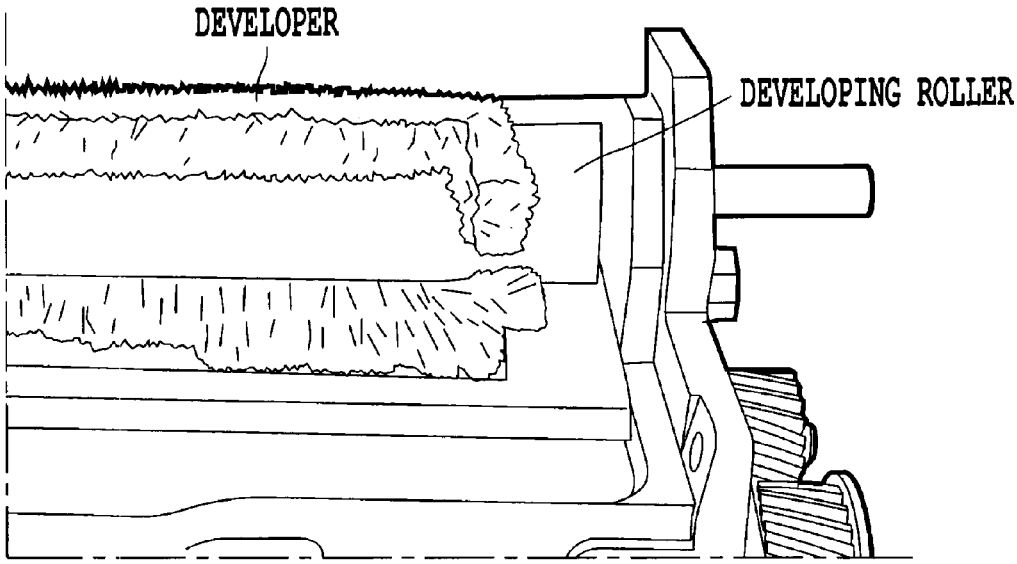
FIG. 15 is a view showing an adsorbed state of a developer at an end portion of a conventional developing roller.

FIG. 14 shows an adsorbed state of the developer at the end portion of the developing roller according to the present invention, and FIG. 15 shows an adsorbed state of the developer at the end portion of the conventional developing roller. The developing roller shown in FIG. 14 is formed so that the half-value width of the magnetic flux density at both the end portions of a developing roller is narrower than the half-value width of the magnetic flux density at the central portion thereof. The developing roller shown in FIG. 15 is formed so that the half-value width of the magnetic flux density at both the end portions of a developing roller is identical to the half-value width of the magnetic flux density at the central portion thereof. If the adsorbed states of the developer at the end portion in FIG. 14 and FIG. 15 are compared, it is found that the range in which the developing roller according to the present invention adsorbs a developer is made small (narrow) to the circumferential direction.

Furthermore, the inventors of the present invention carried out a test that examines a relation between the ratio of the half-value width at the central portion and the half-value width at both the end portions, and the entrainment of a developer, in the agent separating pole P4.

The magnet roller 25 of the developing roller 16 that was made of an anisotropic strontium ferrite and an ethylene ethyl acrylate copolymer, and was magnetized by using the magnetizing jig 500 (500A, 500B) mentioned above to the body part 30 formed in 16 mm of the outer diameter ϕ and 309 mm of the length was used. In detail, the magnetic poles P1 to P3, P5, and P6 were magnetized by using the magnetizing jig 500B, and the magnetic pole P4 (agent separating pole) was magnetized by using the magnetizing jig 500A or 500B. The multiple developing rollers 16 having 37° of the half-value width at the central portion of the agent separating pole P4 and the different half-value widths at both the end portions as shown in Table 5 were produced. The magnetic flux density of these developing rollers 16 in the agent separating pole P4 was set at 47±0.5 mT. The magnetic property of the developing roller 16 is measured by using an HGM-8900 type gauss meter manufactured by ADS Corporation. The measurement is performed by contacting the gauss meter against the outer circumferential face of the developing roller 16, and the magnetic flux density distribution (normal magnetic property) is determined based on the value obtained by converting the amount of gausses into voltage in the gauss meter. The half-value central angle uses a D cut face 29*a* of the cored bar 29 as a reference and follows the angle in the counter clockwise direction for the right side of the D cut face as 0°, as shown in FIG. 7. In other words, in FIG. 7, when the D cut face 29*a* directs upward, the right of the D cut face 29*a* is 0°, the top thereof is 90°, the left thereof 180°, and the bottom thereof is 270°. Furthermore, the developing sleeve 26 of the developing roller 16 is made of aluminum A6063, and is formed with the outer diameter ϕ of 18 mm, with the internal diameter of 16.5 mm, and with the length of 326 mm, and the SWB mentioned above is subjected thereto as surface roughening processing to the outer circumferential face 26*a* thereof. The two component developer mentioned above having 35 μm of the average particle diameter of the magnetic carrier is used as a developer. The multiple developing rollers 16 shown in Table 5 were incorporated into the color copier 50 mentioned above, the entrainment of a developer in the agent separating pole P4 was checked visually, a determination was made based on the following references.

○ without the entrainment of a developer
x with the entrainment of a developer

TABLE 5

| Agent separating pole | | |
|---|---|---|
| Half-value width [°] | Ratio with respect to half-value width at central portion [%] | Evaluation result |
| 40.3 | 108.9 | x |
| 39.1 | 105.7 | x |
| 38.2 | 103.2 | x |
| 37.0 | 100.0 | ○ |
| 36.0 | 97.3 | ○ |
| 35.1 | 94.9 | ○ |
| 33.9 | 91.6 | ○ |
| 33.0 | 89.2 | ○ |
| 32.1 | 86.8 | ○ |
| 31.1 | 84.1 | ○ |
| 30.5 | 82.4 | ○ |
| 30.0 | 81.1 | ○ |
| 29.5 | 79.7 | x |
| 28.9 | 78.1 | x |
| 27.9 | 75.4 | x |

○ without the entrainment of a developer
x with the entrainment of a developer

Figure 16:
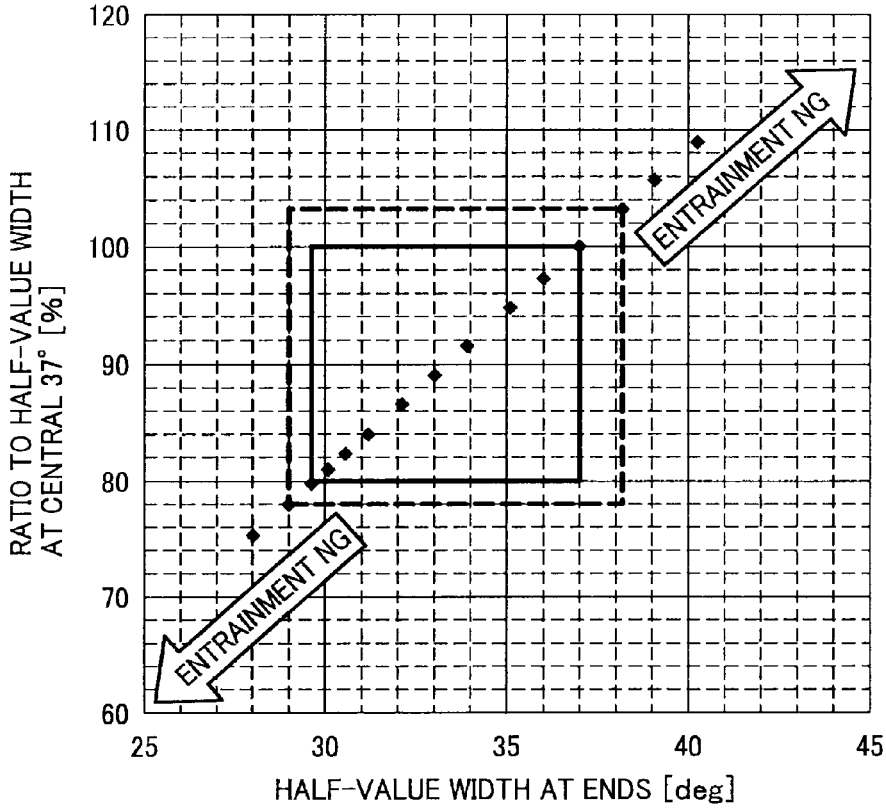
FIG. 16 is a graph showing a tendency of the ratio of the half-value width of the magnetic flux density at both the end portions of an agent separating pole with respect to the half-value width of the magnetic flux density at the central portion thereof, and the entrainment of a developer.

From the result shown in Table 5, it is found that, in the agent separating pole P4, when the half-value width of the magnetic flux density at both the end portions is within 80 to 100% with respect to the half-value width of the magnetic flux density at the central portion thereof, the entrainment of a developer does not occur, while when it is smaller (narrower) than 80% or larger (wider) than 100%, the entrainment of a developer occurs. FIG. 16 shows a tendency of the ratio of the half-value width of the magnetic flux density at both the end portions of the agent separating pole P4 with respect to the half-value width of the magnetic flux density in the central portion thereof, and the entrainment of a developer. In FIG.

16, the inside of the solid line indicates a judgment result of "○", and the outside of the solid line indicates a judgment result of "x". The inside of the dotted line indicates that although the entrainment of a developer in the initial evaluation can be permitted, a problem may occur temporally, so that it results in a judgment result of "x". Accordingly, it is found that when the half-value width of the magnetic flux density at both the end portions of the agent separating pole P4 is within the range of 80 to 100% with respect to the half-value width of the magnetic flux density at the central portion thereof, the entrainment of a developer is prevented so that the concentration unevenness (void) of an image can be prevented.

Furthermore, the inventors of the present invention carried out a test that examines a relation between the ratio of the half-value width at the central portion and the half-value width at both the end portions, and the entrainment of a developer, in the scooping pole P6.

The magnet roller 25 of the developing roller 16 that was made of an anisotropic strontium ferrite and an ethylene ethyl acrylate copolymer, and was magnetized by using the magnetizing jig 500 (500A, 500B) mentioned above for the body part 30 formed with the outer diameter ϕ of 16 mm and with the length of 309 mm was used. In detail, the magnetic poles P1 to P3 and P5 were magnetized by using the magnetizing jig 500B, whereas the magnetic pole P4 (agent separating pole) and the magnetic pole P6 (scooping pole) were magnetized by using the magnetizing jig 500A or 5008. The multiple developing rollers 16 having the half-value width of 49.5° at the central portion of the scooping pole P6 and having the different half-value widths at both the end portions as shown in Table 6 were produced. The magnetic flux density of these developing rollers 16 in the scooping pole P6 was set at 63.5±0.5 mT. The magnetic property of the developing roller 16 is measured by using an HGM-8900 type gauss meter manufactured by ADS Corporation. The measurement is performed by contacting the gauss meter against the outer circumferential face of the developing roller 16, and the magnetic flux density distribution (normal magnetic property) is determined based on the value obtained by converting the amount of gausses into voltage in the gauss meter. The half-value central angle uses a D cut face 29*a* of the cored bar 29 as a reference and follows the angle in the counter clockwise direction for the right side of the D cut face as 0°, as shown in FIG. 7. In other words, in FIG. 7, when the D cut face 29*a* directs upward, the right of the D cut face 29*a* is 0°, the top thereof is 90°, the left thereof is 180°, and the bottom thereof is 270°. Furthermore, the developing sleeve 26 of the developing roller 16 is made of aluminum A6063, and is formed with the outer diameter ϕ of 18 mm, with the internal diameter of 16.5 mm, and with the length of 326 mm, and the SWB mentioned above is subjected thereto as surface roughening processing to the outer circumferential face 26*a* thereof. The two component developer mentioned above having 35 μm of the average particle diameter of the magnetic carrier is used as a developer. The multiple developing rollers 16 shown in Table 6 were incorporated into the color copier 50 mentioned above, a test solid image was printed, the concentration unevenness (void at the end portion) of the printed image was checked visually, and a determination was made based on the following references.

○ image has no problem x image has problems (scaly image, and poor scooping)

TABLE 6

| Scooping pole | | |
|---|---|---|
| Half-value width [°] | Ratio with respect to half-value width at central portion [%] | Evaluation result |
| 54.0 | 109.1 | x |
| 52.5 | 106.1 | x |
| 51.0 | 103.0 | x |
| 49.5 | 100.0 | ○ |
| 47.5 | 96.0 | ○ |
| 46.0 | 92.9 | ○ |
| 45.5 | 91.9 | ○ |
| 44.5 | 89.9 | x |
| 43.5 | 87.9 | x |
| 41.9 | 84.6 | x |
| 41.5 | 83.8 | x |
| 40.8 | 82.4 | x |

○ image has no problem x image has problems (scaly image, and poor scooping)

Figure 17:
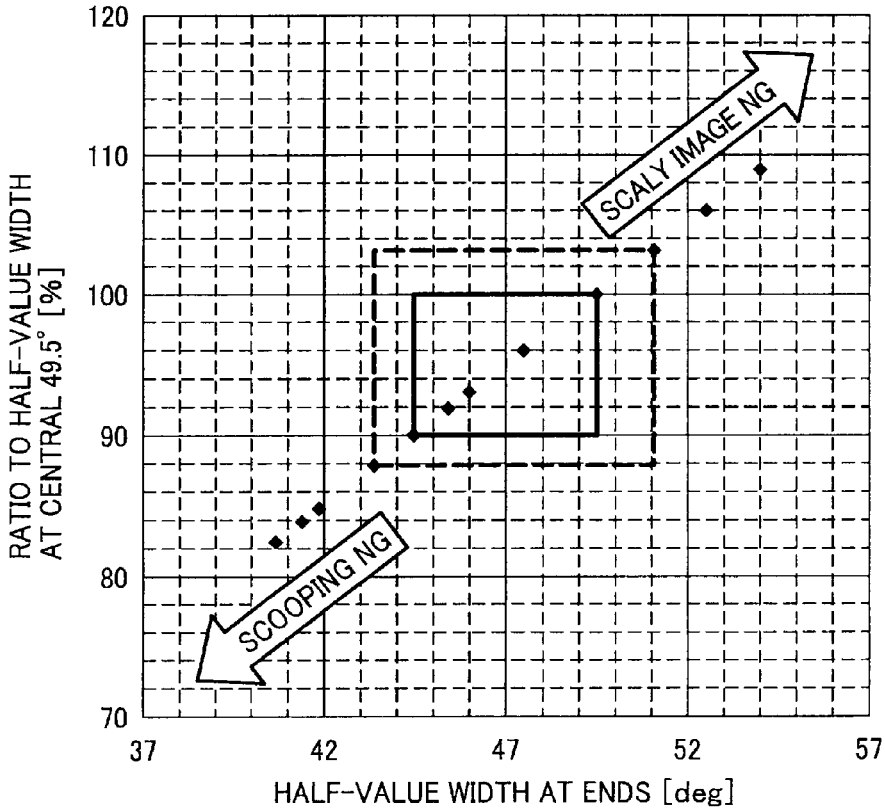
FIG. 17 is a graph showing a tendency of the ratio of the half-value width of the magnetic flux density at both the end portions of a scooping pole with respect to the half-value width of the magnetic flux density in the central portion thereof, and the concentration unevenness.

From the result shown in Table 6, it is found that, in the scooping pole P6, when the half-value width of the magnetic flux density at both the end portions is in a range of 90 to 100% with respect to the half-value width of the magnetic flux density at the central portion thereof, the concentration unevenness does not occur and a good image can be obtained, when it is smaller (narrower) than 90%, poor scooping of a developer occurs and unevenness occurs in the image concentration, and when it is larger (wider) than 100%, scale-shaped concentration unevenness (scaly image) occurs. FIG. 17 shows a tendency of the ratio of the half-value width of the magnetic flux density at both the end portions of the scooping pole P6 with respect to the half-value width of the magnetic flux density at the central portion thereof, and the concentration unevenness. In FIG. 17, the inside of the solid line indicates a judgment result of "○", and the outside of the solid line indicates a judgment result of "x". The inside of the dotted line indicates that although the entrainment of a developer in the initial evaluation can be permitted, a problem may occur temporally, so that it results in a judgment result of "x". Accordingly, it is found that when the half-value width of the magnetic flux density at both the end portions of the scooping pole P6 is in the range of 90 to 100% with respect to the half-value width of the magnetic flux density at the central portion thereof, the concentration unevenness of an image can be prevented.

Although the preferred embodiments of the present invention have been described, it should be understood that the present invention is not limited to these embodiments, various modifications and changes can be made to the embodiments.

What is claimed is:

1. A developer carrier comprising:

a magnetic field generating device provided with a plurality of magnetic poles including an agent separating pole and a scooping pole; and a cylindrical hollow body accommodating therein the magnetic field generating device and rotated around an axis of the cylindrical hollow body, wherein a half-value width of a magnetic flux density at both end portions of at least one magnetic pole of the agent separating pole and the scooping pole is formed to be identical to or narrower than a half-value width of the magnetic flux density at a central portion of the one magnetic pole.

2. The developer carrier according to claim 1, wherein the half-value width of the magnetic flux density at both the end portions of the agent separating pole is formed to be identical to or narrower than the half-value width of the magnetic flux density at the central portion of the agent separating pole, and a center position of the half-value width of the magnetic flux density at both the end portions of the agent separating pole is arranged upstream of a center position of the half-value width of the magnetic flux density at the central portion of the agent separating pole in a rotational direction of the hollow body.

3. The developer carrier according to claim 1, wherein the half-value width of the magnetic flux density at both the end portions of the scooping pole is formed to be identical to or narrower than the half-value width of the magnetic flux density at the central portion of the scooping pole, and a center position of the half-value width of the magnetic flux density at both the end portions of the scooping pole is arranged downstream of a center position of the half-value width of the magnetic lux density at the central portion of the scooping pole in a rotational direction of the hollow body.

4. The developer carrier according to claim 1, wherein surface roughening processing is performed on an outer circumferential face of the hollow body in such a way that a plurality of line materials are caused, by the rotating magnetic field, to rotate along the outer circumferential face of the hollow body while each rotating on an axis of the line material, and to thereby collide with the outer circumferential face.

5. A development device having at least a developer carrier, wherein, as the developer carrier, the development device has the developer carrier according to claim 1.

6. The development device according to claim 5, wherein a developer carried by the developer carrier includes toner and a magnetic carrier, and an average particle diameter of the magnetic carrier is set at 20 μm to 50 μm.

7. A process cartridge having at least a development device, wherein, as the development device, the process cartridge has the development device according to claim 5.

8. An image forming apparatus having at least a development device, wherein, as the development device, the image forming apparatus has the development device according to claim 5.

9. An image forming apparatus provided at least with a process cartridge having at least a development device, wherein, as the process cartridge, the image forming apparatus is provided with the process cartridge according to claim 7.

* * * * *